US010607476B1

(12) United States Patent
Stewart et al.

(10) Patent No.: US 10,607,476 B1
(45) Date of Patent: Mar. 31, 2020

(54) BUILDING SECURITY SYSTEM WITH SITE RISK REDUCTION

(71) Applicant: Johnson Controls Technology Company, Auburn Hills, MI (US)

(72) Inventors: Michael C. Stewart, Deerfield Beach, FL (US); Jonathan M. Dangaran, Boca Raton, FL (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 16/368,611

(22) Filed: Mar. 28, 2019

(51) Int. Cl.

| | |
|---|---|
| ***G08B 29/14*** | (2006.01) |
| ***G08B 29/16*** | (2006.01) |
| ***G08B 29/04*** | (2006.01) |
| ***G08B 26/00*** | (2006.01) |
| ***G08B 29/06*** | (2006.01) |
| ***G08B 29/12*** | (2006.01) |

(52) U.S. Cl.
CPC ..... *G08B 29/14* (2013.01); *G08B 26/001* (2013.01); *G08B 29/04* (2013.01); *G08B 29/06* (2013.01); *G08B 29/123* (2013.01); *G08B 29/16* (2013.01)

(58) Field of Classification Search
CPC ..... G08B 29/14; G08B 26/001; G08B 29/04; G08B 29/06; G08B 29/123; G08B 29/16
USPC ..... 340/506, 511
See application file for complete search history.

(56) References Cited

U.S. PATENT DOCUMENTS

| | | | | |
|---|---|---|---|---|
| 5,917,409 | A | 6/1999 | Wang | |
| 6,157,299 | A | 12/2000 | Wang | |
| 6,166,633 | A | 12/2000 | Wang | |
| 6,198,389 | B1 | 3/2001 | Buccola | |
| 7,302,481 | B1 | 11/2007 | Wilson | |
| 2002/0170002 | A1 | 11/2002 | Steinberg et al. | |
| 2004/0183666 | A1 | 9/2004 | Wang | |
| 2004/0250133 | A1 | 12/2004 | Lim | |
| 2006/0250231 | A1 | 11/2006 | Wang et al. | |
| 2006/0291657 | A1 | 12/2006 | Benson et al. | |
| 2010/0090822 | A1 | 4/2010 | Benson et al. | |
| 2013/0033375 | A1 | 2/2013 | Doyle et al. | |
| 2013/0190095 | A1 | 7/2013 | Gadher et al. | |
| 2013/0260720 | A1* | 10/2013 | Miyaki | H04W 12/08 455/411 |
| 2014/0211002 | A1 | 7/2014 | Lin et al. | |
| 2017/0180829 | A1* | 6/2017 | Schwarzkopf | H04Q 9/00 |
| 2018/0089988 | A1* | 3/2018 | Schwarzkopf | H04Q 9/00 |

(Continued)

*Primary Examiner* — Ojiako K Nwugo
(74) *Attorney, Agent, or Firm* — Foley & Lardner LLP

(57) ABSTRACT

Systems and methods for identifying at risk building sites. The security system includes a processing circuit configured to receive building security data from the plurality of building sites, the building security data indicating one or more vulnerability time periods for each of the plurality of building sites and determine an average vulnerability time period associated with each of the plurality building sites based on the one or more vulnerability time periods. The processing circuit can also be configured to determine a tunable threshold associated with the average vulnerability time period; determine whether each of the plurality of building sites are at risk by determining whether a current vulnerability time period for each building site is greater than the tunable threshold associated with the average vulnerability time period; and generate a report indicating one or more of the plurality of building sites that are at risk.

20 Claims, 16 Drawing Sheets

(56) References Cited

U.S. PATENT DOCUMENTS

| | | | | |
|---|---|---|---|---|
| 2018/0102045 | A1 | 4/2018 | Simon | |
| 2018/0315299 | A1* | 11/2018 | Subramanian | G06K 9/6278 |
| 2018/0365593 | A1 | 12/2018 | Galitsky | |
| 2018/0375444 | A1* | 12/2018 | Gamroth | H04Q 9/00 |
| 2019/0294136 | A1* | 9/2019 | Iacobone | G05B 19/0428 |

* cited by examiner 610 608 612

| | |
|---|---|
| 12:00 AM | Still armed from yesterday |
| 8:00 AM | Disarmed when store opens |
| 9:00 PM | Armed when store closes |
| 9:30 PM | Communication Failure |
| 10:30 PM | Communication restored; remotely rearmed |
| 11:59 PM | Still armed at end of day |

700

| December Arming Activity | | | | | | |
|---|---|---|---|---|---|---|
| Sunday | Monday | Tuesday | Wednesday | Thursday | Friday | Saturday |
| | | 702 | | | | 11Hr |
| 11Hr | 11Hr | 11Hr | 11Hr | 11Hr | 11Hr | 11Hr |
| 11Hr | 11Hr | 11Hr | 4Hr | 704 20Min | 706 11Hr | 11Hr |
| 11Hr | 11Hr | 11Hr | 11Hr | 11Hr | 11Hr | 11Hr |
| 11Hr | 11Hr | 11Hr | 11Hr | 11Hr | 11Hr | 11Hr |
| 11Hr | 11Hr | | | | | |

FIG. 7

BUILDING SECURITY SYSTEM WITH SITE RISK REDUCTION

BACKGROUND

The present disclosure relates generally to building security systems of a building. The present disclosure relates more particularly to systems and methods for reducing the number of at risk building sites of a security system.

At building sites, various security systems provide security monitoring and fire detection and response functions. The security systems that provide the security monitoring and fire detection can cause a serious problem when they are not properly armed or malfunction for prolonged periods of time. Such periods of time can be identified as site risks. Site risks at a building site can, in some cases, be attributable to preventable causes, such as an employee forgetting to turn on the alarm system after leaving for the night or an alarm not being reset after it goes off. In some cases, building sites can be at risk because of faulty equipment, such as a smoke detector having a low battery or a controller that controls the security system having an operating system error that causes each security system and device the controller controls to go offline. Often, particular building sites will have more than one issue that causes them to be at risk. It can be difficult to recognize if the issues at the building sites are recurring issues that need to be addressed or if some issues can be ignored while other issues are addressed because security systems often monitor many building sites, and each site faces its own share of site risks. Consequently, it is difficult to identify possible recommendations or actions that can be taken to fix identified issues at building sites that are constantly at risk of a security breach and/or a fire emergency.

SUMMARY

In one implementation of the present disclosure, a security system for identifying at risk building sites, the security system in communication with a plurality of security subsystems of a plurality of building sites, is disclosed. The security system includes a processing circuit configured to receive building security data from the plurality of building sites, the building security data indicating one or more vulnerability time periods for each of the plurality of building sites;

determine an average vulnerability time period associated with each of the plurality building sites based on the one or more vulnerability time periods; and determine a tunable threshold associated with the average vulnerability time period. The processing circuit is also configured to determine whether each of the plurality of building sites are at risk by determining whether a current vulnerability time period for each building site is greater than the tunable threshold associated with the average vulnerability time period and generate a report indicating one or more of the plurality of building sites that are at risk.

In some embodiments, the processing circuit is configured to provide the report on a graphical user interface displaying reports associated with each of the plurality of building sites.

In some embodiments, the building security data includes risk data of the plurality of building sites, wherein the risk data indicates a plurality of different risk types including at least one of one or more security subsystems not being armed, one or more pieces of equipment not being reset after an alarm, one or more zones being bypassed, one or more communication failure events, or one or more supervisory system failure events.

In some embodiments, the processing circuit is configured to determine risk vulnerability time periods based on the risk data for each of the plurality of risk types for each of the plurality of building sites.

In some embodiments, the processing circuit is configured to determine the current vulnerability time period for each building site by aggregating the risk vulnerability time periods for each building site.

In some embodiments, the tunable threshold is particular to each building site. The processing circuit is configured to determine whether each of the plurality of building sites are in a risk state by determining whether the current vulnerability time period of the building site exceeds the tunable threshold particular to each building site.

In some embodiments, the processing circuit is configured to determine the tunable threshold particular to each building site based on historical vulnerable time periods associated with each building site.

In some embodiments, each of the plurality of building sites is associated with a counter of a plurality of counters. The processing circuit is configured to increment the counter of each of the plurality of building sites in response to a determination that a state of the building site becomes the risk state.

In some embodiments, the processing circuit is configured to determine a group of building sites of the plurality of building sites with highest count values by analyzing a count value of each of the plurality of counters.

In another implementation of the present disclosure, a method for identifying at risk building sites is disclosed. The method is conducted by a processing circuit and includes receiving, by the processing circuit, building security data from the plurality of building sites, the building security data indicating one or more historical vulnerability time periods for each of the plurality of building sites; determining, by the processing circuit, an average vulnerability time period associated with each of the plurality building sites based on the one or more vulnerability time periods; and determining, by the processing circuit, a tunable threshold associated with the average vulnerability time period. The method also includes determining, by the processing circuit, whether each of the plurality of building sites are at risk by determining whether a current vulnerability time period for each building site is greater than the tunable threshold associated with the average vulnerability time period; and generating, by the processing circuit, a report indicating one or more of the plurality of building sites that are at risk.

In some embodiments, the method includes providing, by the processing circuit, the report on a graphical user interface displaying reports associated with each of the plurality of building sites.

In some embodiments, the method includes determining, by the processing circuit, acceptable time periods for each of the plurality of building sites to be in an at risk state, and remove building security data associated with the acceptable time periods from the building security data.

In some embodiments, the building security data includes risk data of the plurality of building sites, wherein the risk data indicates a plurality of different risk types including at least one of one or more security subsystems not being armed, one or more pieces of equipment not being reset after an alarm, one or more zones being bypassed, one or more communication failure events, or one or more supervisory system failure events.

In some embodiments, the method includes determining, by the processing circuit, risk vulnerability time periods based on the risk data for each of the plurality of risk types for each of the plurality of building sites.

In some embodiments, the method includes determining the current vulnerability time period for each building site by aggregating the risk vulnerability time periods for each building site.

In some embodiments, the tunable threshold is particular to each building site. The method includes determining whether each of the plurality of building sites are in a risk state by determining whether the current vulnerability time period of the building site exceeds the tunable threshold particular to each building site.

In some embodiments, determining the tunable threshold particular to each building site is based on historical vulnerable time periods associated with each building site.

In another implementation, a non-transitory computer-readable storage medium having instructions stored thereon that, upon execution by a processor, cause the processor to perform operations to identify at risk building sites is disclosed. The operations including receiving building security data from a plurality of building sites, the building security data indicating one or more historical vulnerability time periods for each of the plurality of building sites; determining an average vulnerability time period associated with each of the plurality building sites based on the one or more vulnerability time periods; and determining a tunable threshold associated with the average vulnerability time period. The operations further including determining whether each of the plurality of building sites are at risk by determining whether a current vulnerability time period for each building site is greater than the tunable threshold associated with the average vulnerability time period and generating a report indicating one or more of the plurality of building sites that are at risk.

In some embodiments, the operations include providing the report on a graphical user interface displaying reports associated with each of the plurality of building sites.

In some embodiments, the building security data includes risk data of the plurality of building sites, wherein the risk data indicates a plurality of different risk types including at least one of one or more security subsystems not being armed, one or more pieces of equipment not being reset after an alarm, one or more zones being bypassed, one or more communication failure events, or one or more supervisory system failure events.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

FIG. 7 is a calendar illustrating how often a particular building site is at risk on a daily basis, according to an exemplary embodiment.

DETAILED DESCRIPTION

Overview

Figure 1:
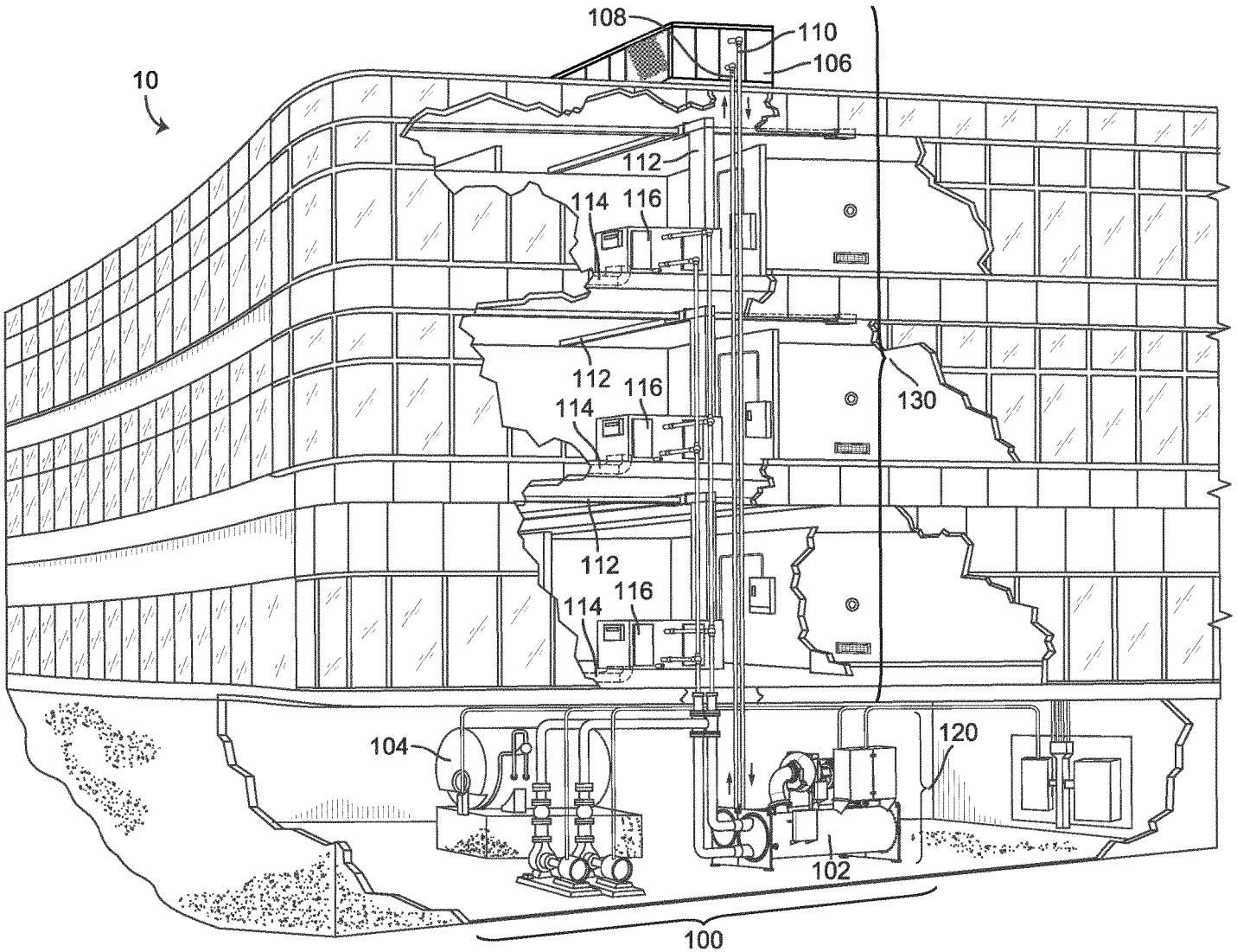
FIG. 1 is a drawing of a building equipped with a HVAC system, according to an exemplary embodiment.

Methods can be used to determine which building sites are the most at risk over the course of an administrator set time period. One such method includes determining an average time that multiple building sites are at risk on a daily basis, determining a tunable threshold in relation to the average time, and comparing how long building sites are at risk within the time period to the tunable threshold. Additionally, similar techniques can be used to determine at risk building sites, but instead of comparing time at risk to the tunable threshold on a daily basis, the total time at risk of each building site over a time period can be compared to a tunable threshold associated with the average total time at risk of each building site. For both techniques, any instances that a building site is at risk over the threshold can be flagged as a day or time period that the site was at risk for a longer period of time than an administrator deems acceptable or than a system determined to be acceptable based on historical data.

A system can determine tunable thresholds for building sites based on historical security data indicating time periods that particular building sites were at risk. The system can do so by determining the average time at risk for a particular building site over a period of time associated with the historical security data and adjusting a tunable threshold based on the average time at risk accordingly. For example, if a retail store is open 20 hours a day 7 days a week instead of 13 hours a day like most other building sites in communication with a building security system, the building security system could automatically determine that alarms associated with the retail store should only be armed for four hours a day instead of 11. Consequently, the security system could adjust the tunable threshold associated with the retail store to require a lower amount of time at risk to be over a tunable threshold than other building sites that communicate with the security system.

Systems and methods that do not implement the system and methods described herein generally cannot automatically identify building sites that are the most at risk and need to change operation or equipment. Instead, these building security systems can identify individual issues that occur that cause the building sites to be at risk and provide potential recommendations to solve the individual issues. Each solution is temporary and narrow to the building site without any determination for which building sites need to be adjusted the most.

The systems and methods disclosed herein can assess and reduce time periods that building sites are at risk of security breaches and fire hazards by accurately identifying which building sites are the most at risk compared to one another based on data collected at each building site and by the security system. The systems and methods can identify the building sites and send a report including instructions to the identified building sites indicating parameters that can be changed at the building sites so the building sites can be more secure (e.g., automatically arm the alarm system more often, increase sensitivity of sensors so they can continuously retrieve and provide data, etc.). Further, the systems and methods described herein can generate and provide a report at a graphical user interface showing the results of analysis that was done to determine building sites that are the most at risk.

Building Management System and HVAC System

Referring now to FIG. 1, an exemplary building management system (BMS) and HVAC system in which the systems and methods of the present invention can be implemented are shown, according to an exemplary embodiment. Referring particularly to FIG. 1, a perspective view of a building 10 is shown. Building 10 is served by a BMS. A BMS is, in general, a system of devices configured to control, monitor, and manage equipment in or around a building or building area. A BMS can include, for example, a HVAC system, a security system, a lighting system, a fire alerting system, any other system that is capable of managing building functions or devices, or any combination thereof.

The BMS that serves building 10 includes an HVAC system 100. HVAC system 100 can include a plurality of HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 can provide a heated or chilled fluid to an air handling unit of airside system 130. Airside system 130 can use the heated or chilled fluid to heat or cool an airflow provided to building 10. An exemplary waterside system and airside system which can be used in HVAC system 100 are described in greater detail with reference to FIGS. 2-3.

HVAC system 100 is shown to include a chiller 102, a boiler 104, and a rooftop air handling unit (AHU) 106. Waterside system 120 can use boiler 104 and chiller 102 to heat or cool a working fluid (e.g., water, glycol, etc.) and can circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.). The working fluid can be heated in boiler 104 or cooled in chiller 102, depending on whether heating or cooling is required in building 10. Boiler 104 can add heat to the circulated fluid, for example, by burning a combustible material (e.g., natural gas) or using an electric heating element. Chiller 102 can place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 can place the working fluid in a heat exchange relationship with an airflow passing through AHU 106 (e.g., via one or more stages of cooling coils and/or heating coils). The airflow can be, for example, outside air, return air from within building 10, or a combination of both. AHU 106 can transfer heat between the airflow and the working fluid to provide heating or cooling for the airflow. For example, AHU 106 can include one or more fans or blowers configured to pass the airflow over or through a heat exchanger containing the working fluid. The working fluid can then return to chiller 102 or boiler 104 via piping 110.

Airside system 130 can deliver the airflow supplied by AHU 106 (i.e., the supply airflow) to building 10 via air supply ducts 112 and can provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 can include various sensors (e.g., temperature sensors, pressure sensors, etc.) configured to measure attributes of the supply airflow. AHU 106 can receive input from sensors located within AHU 106 and/or within the building zone and can adjust the flow rate, temperature, or other attributes of the supply airflow through AHU 106 to achieve setpoint conditions for the building zone.

Figure 2:
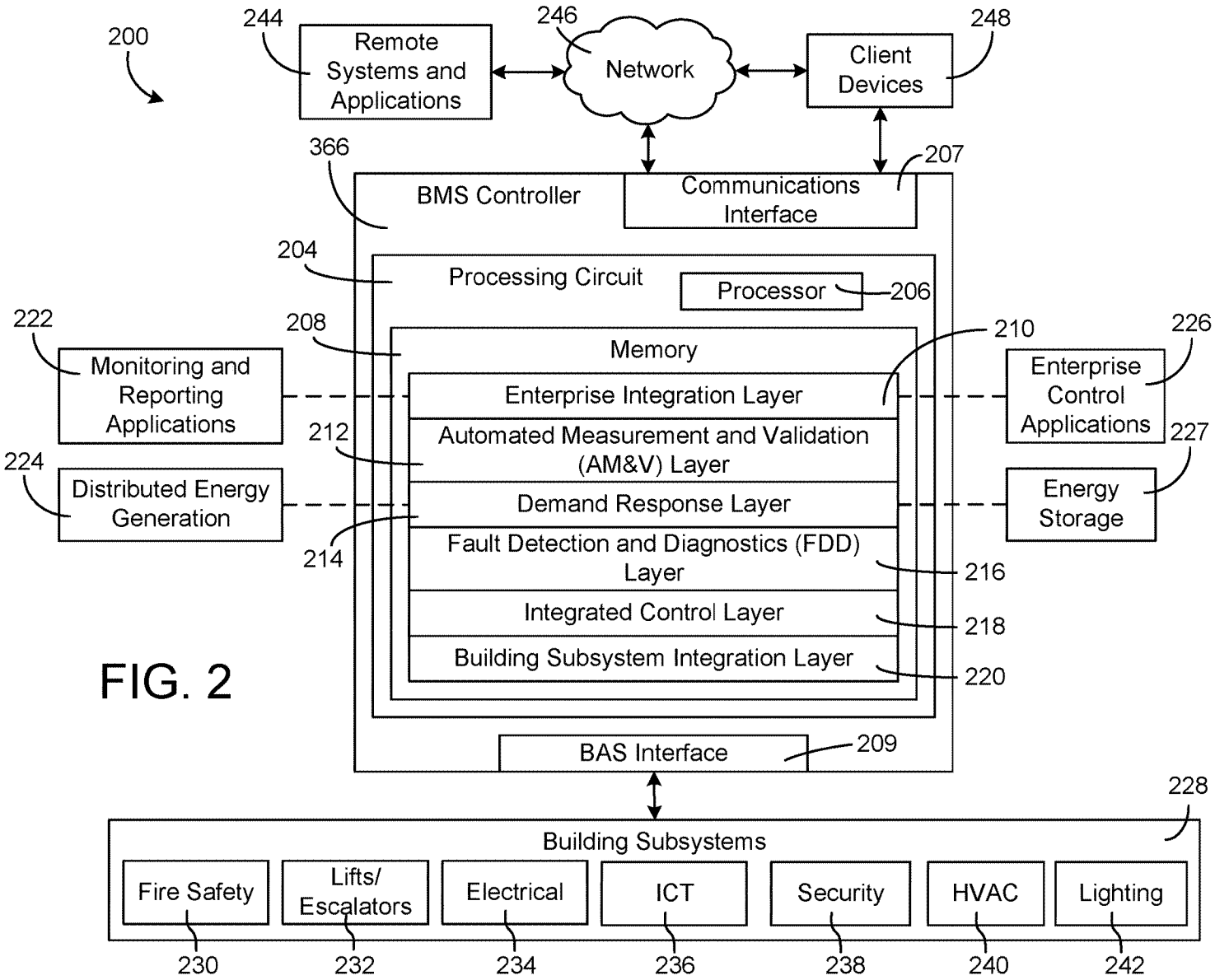
FIG. 2 is a block diagram of a building automation system (BAS) that may be used to monitor and/or control the building of FIG. 1, according to an exemplary embodiment.

Referring now to FIG. 2, a block diagram of a building automation system (BAS) 200 is shown, according to an exemplary embodiment. BAS 200 can be implemented in building 10 to automatically monitor and control various building functions. BAS 200 is shown to include BAS controller 202 and a plurality of building subsystems 228. Building subsystems 228 are shown to include a building electrical subsystem 234, an information communication technology (ICT) subsystem 236, a security subsystem 238, a HVAC subsystem 240, a lighting subsystem 242, a lift/escalators subsystem 232, and a fire safety subsystem 230. In various embodiments, building subsystems 228 can include fewer, additional, or alternative subsystems. For example, building subsystems 228 can also or alternatively include a refrigeration subsystem, an advertising or signage subsystem, a cooking subsystem, a vending subsystem, a printer or copy service subsystem, or any other type of building subsystem that uses controllable equipment and/or sensors to monitor or control building 10. In some embodiments, building subsystems 228 include a waterside system and/or an airside system. A waterside system and an airside system are described with further reference to U.S. patent application Ser. No. 15/631,830 (Publication No. 20180375444), filed Jun. 23, 2017, the entirety of which is incorporated by reference herein.

Each of building subsystems 228 can include any number of devices, controllers, and connections for completing its individual functions and control activities. HVAC subsystem 240 can include many of the same components as HVAC system 100, as described with reference to FIG. 1. For example, HVAC subsystem 240 can include a chiller, a boiler, any number of air handling units, economizers, field controllers, supervisory controllers, actuators, temperature sensors, and other devices for controlling the temperature, humidity, airflow, or other variable conditions within building 10. Lighting subsystem 242 can include any number of light fixtures, ballasts, lighting sensors, dimmers, or other devices configured to controllably adjust the amount of light provided to a building space. Security subsystem 238 can include occupancy sensors, video surveillance cameras, digital video recorders, video processing servers, intrusion detection devices, access control devices and servers, or other security-related devices.

Still referring to FIG. 2, BAS controller 266 is shown to include a communications interface 207 and a BAS interface 209. Interface 207 can facilitate communications between BAS controller 202 and external applications (e.g., monitoring and reporting applications 222, enterprise control applications 226, remote systems and applications 244, applications residing on client devices 248, etc.) for allowing user control, monitoring, and adjustment to BAS controller 266 and/or subsystems 228. Interface 207 can also facilitate communications between BAS controller 202 and client devices 248. BAS interface 209 can facilitate communications between BAS controller 202 and building subsystems 228 (e.g., HVAC, lighting security, lifts, power distribution, business, etc.).

Interfaces 207, 209 can be or include wired or wireless communications interfaces (e.g., jacks, antennas, transmitters, receivers, transceivers, wire terminals, etc.) for conducting data communications with building subsystems 228 or other external systems or devices. In various embodiments, communications via interfaces 207, 209 can be direct (e.g., local wired or wireless communications) or via a communications network 246 (e.g., a WAN, the Internet, a cellular network, etc.). For example, interfaces 207, 209 can include an Ethernet card and port for sending and receiving data via an Ethernet-based communications link or network. In another example, interfaces 207, 209 can include a Wi-Fi transceiver for communicating via a wireless communications network. In another example, one or both of interfaces 207, 209 can include cellular or mobile phone communications transceivers. In one embodiment, communications interface 207 is a power line communications interface and BAS interface 209 is an Ethernet interface. In other embodiments, both communications interface 207 and BAS interface 209 are Ethernet interfaces or are the same Ethernet interface.

Still referring to FIG. 2, BAS controller 202 is shown to include a processing circuit 204 including a processor 206 and memory 208. Processing circuit 204 can be communicably connected to BAS interface 209 and/or communications interface 207 such that processing circuit 204 and the various components thereof can send and receive data via interfaces 207, 209. Processor 206 can be implemented as a general purpose processor, an application specific integrated circuit (ASIC), one or more field programmable gate arrays (FPGAs), a group of processing components, or other suitable electronic processing components.

Memory 208 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 208 can be or include volatile memory or non-volatile memory. Memory 208 can include database components, object code components, script components, or any other type of information structure for supporting the various activities and information structures described in the present application. According to an exemplary embodiment, memory 208 is communicably connected to processor 206 via processing circuit 402 and includes computer code for executing (e.g., by processing circuit 204 and/or processor 206) one or more processes described herein.

In some embodiments, BAS controller 202 is implemented within a single computer (e.g., one server, one housing, etc.). In various other embodiments BAS controller 202 can be distributed across multiple servers or computers (e.g., that can exist in distributed locations). Further, while applications 222 and 226 exists outside of BAS controller 202, in some embodiments, applications 222 and 226 can be hosted within BAS controller 202 (e.g., within memory 208).

Still referring to FIG. 2, memory 208 is shown to include an enterprise integration layer 210, an automated measurement and validation (AM&V) layer 212, a demand response (DR) layer 214, a fault detection and diagnostics (FDD) layer 216, an integrated control layer 218, and a building subsystem integration later 220. Layers 210-220 can be configured to receive inputs from building subsystems 228 and other data sources, determine optimal control actions for building subsystems 228 based on the inputs, generate control signals based on the optimal control actions, and provide the generated control signals to building subsystems 228. The following paragraphs describe some of the general functions performed by each of layers 210-220 in BAS 200.

Enterprise integration layer 210 can be configured to serve clients or local applications with information and services to support a variety of enterprise-level applications. For example, enterprise control applications 226 can be configured to provide subsystem-spanning control to a graphical user interface (GUI) or to any number of enterprise-level business applications (e.g., accounting systems, user identification systems, etc.). Enterprise control applications 226 can also or alternatively be configured to provide configuration GUIs for configuring BAS controller 202. In yet other embodiments, enterprise control applications 226 can work with layers 210-220 to optimize building performance (e.g., efficiency, energy use, comfort, or safety) based on inputs received at interface 207 and/or BAS interface 209.

Building subsystem integration layer 220 can be configured to manage communications between BAS controller 202 and building subsystems 228. For example, building subsystem integration layer 220 can receive sensor data and input signals from building subsystems 228 and provide output data and control signals to building subsystems 228. Building subsystem integration layer 220 can also be configured to manage communications between building subsystems 228. Building subsystem integration layer 220 translates communications (e.g., sensor data, input signals, output signals, etc.) across a plurality of multi-vendor/multi-protocol systems.

Demand response layer 214 can be configured to optimize resource usage (e.g., electricity use, natural gas use, water use, etc.) and/or the monetary cost of such resource usage in response to satisfy the demand of building 10. The optimization can be based on time-of-use prices, curtailment signals, energy availability, or other data received from utility providers, distributed energy generation systems 224, from energy storage 227, or from other sources. Demand response layer 214 can receive inputs from other layers of BAS controller 202 (e.g., building subsystem integration layer 220, integrated control layer 218, etc.). The inputs received from other layers can include environmental or sensor inputs such as temperature, carbon dioxide levels, relative humidity levels, air quality sensor outputs, occupancy sensor outputs, room schedules, and the like. The inputs can also include inputs such as electrical use (e.g., expressed in kWh), thermal load measurements, pricing information, projected pricing, smoothed pricing, curtailment signals from utilities, and the like.

According to an exemplary embodiment, demand response layer 214 includes control logic for responding to the data and signals it receives. These responses can include communicating with the control algorithms in integrated control layer 218, changing control strategies, changing setpoints, or activating/deactivating building equipment or subsystems in a controlled manner. Demand response layer 214 can also include control logic configured to determine when to utilize stored energy. For example, demand response layer 214 can determine to begin using energy from energy storage 227 just prior to the beginning of a peak use hour.

In some embodiments, demand response layer 214 includes a control module configured to actively initiate control actions (e.g., automatically changing setpoints) which minimize energy costs based on one or more inputs representative of or based on demand (e.g., price, a curtailment signal, a demand level, etc.). In some embodiments, demand response layer 214 uses equipment models to determine an optimal set of control actions. The equipment models can include, for example, thermodynamic models describing the inputs, outputs, and/or functions performed by various sets of building equipment. Equipment models can represent collections of building equipment (e.g., subplants, chiller arrays, etc.) or individual devices (e.g., individual chillers, heaters, pumps, etc.).

Demand response layer 214 can further include or draw upon one or more demand response policy definitions (e.g., databases, XML files, etc.). The policy definitions can be edited or adjusted by a user (e.g., via a graphical user interface) so that the control actions initiated in response to demand inputs can be tailored for the user's application, desired comfort level, particular building equipment, or based on other concerns. For example, the demand response policy definitions can specify which equipment can be turned on or off in response to particular demand inputs, how long a system or piece of equipment should be turned off, what setpoints can be changed, what the allowable set point adjustment range is, how long to hold a high demand setpoint before returning to a normally scheduled setpoint, how close to approach capacity limits, which equipment modes to utilize, the energy transfer rates (e.g., the maximum rate, an alarm rate, other rate boundary information, etc.) into and out of energy storage devices (e.g., thermal storage tanks, battery banks, etc.), and when to dispatch on-site generation of energy (e.g., via fuel cells, a motor generator set, etc.).

Integrated control layer 218 can be configured to use the data input or output of building subsystem integration layer 220 and/or demand response later 214 to make control decisions. Due to the subsystem integration provided by building subsystem integration layer 220, integrated control layer 218 can integrate control activities of the subsystems 228 such that the subsystems 228 behave as a single integrated supersystem. In an exemplary embodiment, integrated control layer 218 includes control logic that uses inputs and outputs from a plurality of building subsystems to provide greater comfort and energy savings relative to the comfort and energy savings that separate subsystems could provide alone. For example, integrated control layer 218 can be configured to use an input from a first subsystem to make an energy-saving control decision for a second subsystem. Results of these decisions can be communicated back to building subsystem integration layer 220.

Integrated control layer 218 is shown to be logically below demand response layer 214. Integrated control layer 218 can be configured to enhance the effectiveness of demand response layer 214 by enabling building subsystems 228 and their respective control loops to be controlled in coordination with demand response layer 214. This configuration can reduce disruptive demand response behavior relative to conventional systems. For example, integrated control layer 218 can be configured to assure that a demand response-driven upward adjustment to the setpoint for chilled water temperature (or another component that directly or indirectly affects temperature) does not result in an increase in fan energy (or other energy used to cool a space) that would result in greater total building energy use than was saved at the chiller.

Integrated control layer 218 can be configured to provide feedback to demand response layer 214 so that demand response layer 214 checks that constraints (e.g., temperature, lighting levels, etc.) are properly maintained even while demanded load shedding is in progress. The constraints can also include setpoint or sensed boundaries relating to safety, equipment operating limits and performance, comfort, fire codes, electrical codes, energy codes, and the like. Integrated control layer 218 is also logically below fault detection and diagnostics layer 216 and automated measurement and validation layer 212. Integrated control layer 218 can be configured to provide calculated inputs (e.g., aggregations) to these higher levels based on outputs from more than one building subsystem.

Automated measurement and validation (AM&V) layer 212 can be configured to verify that control strategies commanded by integrated control layer 218 or demand response layer 214 are working properly (e.g., using data aggregated by AM&V layer 212, integrated control layer 218, building subsystem integration layer 220, FDD layer 216, or otherwise). The calculations made by AM&V layer 212 can be based on building system energy models and/or equipment models for individual BAS devices or subsystems. For example, AM&V layer 212 can compare a model-predicted output with an actual output from building subsystems 228 to determine an accuracy of the model.

Fault detection and diagnostics (FDD) layer 216 can be configured to provide on-going fault detection for building subsystems 228, building subsystem devices (i.e., building equipment), and control algorithms used by demand response layer 214 and integrated control layer 218. FDD layer 216 can receive data inputs from integrated control layer 218, directly from one or more building subsystems or devices, or from another data source. FDD layer 216 can automatically diagnose and respond to detected faults. The responses to detected or diagnosed faults can include providing an alarm message to a user, a maintenance scheduling system, or a control algorithm configured to attempt to repair the fault or to work-around the fault.

FDD layer 216 can be configured to output a specific identification of the faulty component or cause of the fault (e.g., loose damper linkage) using detailed subsystem inputs available at building subsystem integration layer 220. In other exemplary embodiments, FDD layer 216 is configured to provide "fault" events to integrated control layer 218 which executes control strategies and policies in response to the received fault events. According to an exemplary embodiment, FDD layer 216 (or a policy executed by an integrated control engine or business rules engine) can shut-down systems or direct control activities around faulty devices or systems to reduce energy waste, extend equipment life, or assure proper control response.

FDD layer 216 can be configured to store or access a variety of different system data stores (or data points for live data). FDD layer 216 can use some content of the data stores to identify faults at the equipment level (e.g., specific chiller, specific AHU, specific terminal unit, etc.) and other content to identify faults at component or subsystem levels. For example, building subsystems 228 can generate temporal (i.e., time-series) data indicating the performance of BAS 200 and the various components thereof. The data generated by building subsystems 228 can include measured or calculated values that exhibit statistical characteristics and provide information about how the corresponding system or process (e.g., a temperature control process, a flow control process, etc.) is performing in terms of error from its setpoint. These processes can be examined by FDD layer 216 to expose when the system begins to degrade in performance and alarm a user to repair the fault before it becomes more severe.

Site Risk Reduction

The systems and methods described herein can include a self-healing system, which can automatically update parameters of different building devices to avoid false alarms in the future. The self-healing system can do so based on data the self-healing system receives from a BMS (e.g., a BMS controller) or a root cause analysis system as will be described below. The self-healing system is further described in U.S. patent application Ser. No. 15/947,722 (Publication No. 20180315299), filed Apr. 6, 2018, which is hereby incorporated by reference in its entirety.

Figure 3:
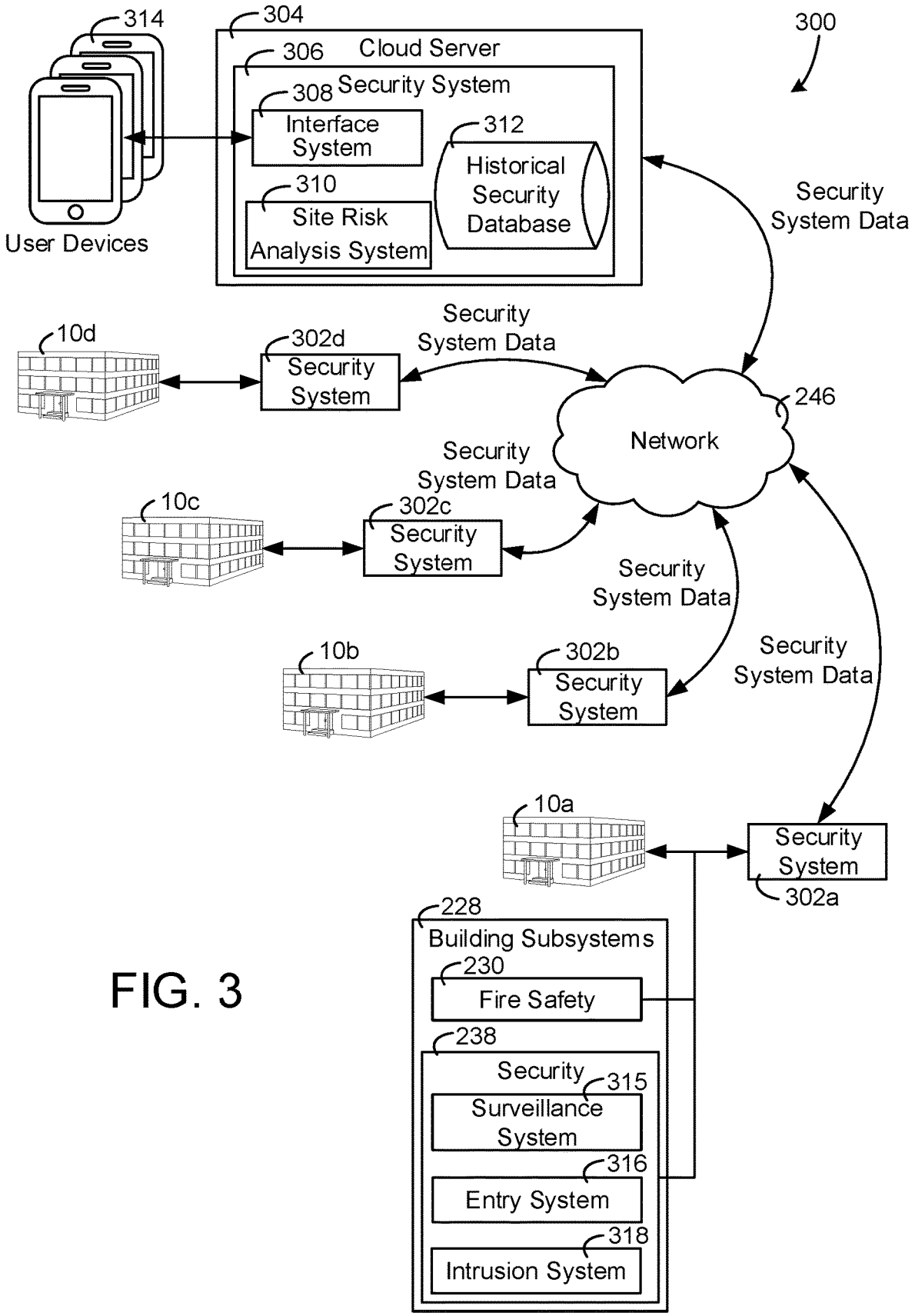
FIG. 3 is a block diagram of building security systems for multiple buildings communicating with a cloud based security system, according to an exemplary embodiment.

Referring now to FIG. 3, a security system 300 for multiple buildings is shown, according to an exemplary embodiment. The security system 300 is shown to include buildings 10*a*-10*d*. Each of buildings 10*a*-10*d* is shown to be associated with a security system 302*a*-302*d*. The buildings 10*a*-10*d* may be the same as and/or similar to building 10 as described with reference to FIG. 1. The security systems 302*a*-302*d* may be one or more controllers, servers, and/or computers located in a security panel or part of a central computing system for a building.

The security systems 302*a*-302*d* may communicate with various security sensors that are part of the building subsystems 228. For example, fire safety subsystems 230 may include various smoke sensors and alarm devices, carbon monoxide sensors and alarm devices, etc. The security subsystems 238 are shown to include a surveillance system 315, an entry system 316, and an intrusion system 318. The surveillance system 315 may include various video cameras, still image cameras, and image and video processing systems for monitoring various rooms, hallways, parking lots, the exterior of a building, the roof of the building, etc. The entry system 316 can include one or more systems configured to allow users to enter and exit the building (e.g., door sensors, turnstiles, gated entries, badge systems, etc.) The intrusion system 318 may include one or more sensors configured to identify whether a window or door has been forced open. The intrusion system 318 can include a keypad module for arming and/or disarming a security system and various motion sensors (e.g., IR, PIR, etc.) configured to detect motion in various zones of the building 10*a*.

Each of buildings 10*a*-10*d* may be located in various cities, states, and/or countries across the world. There may be any number of buildings 10*a*-10*b*. The buildings 10*a*-10*b* may be owned and operated by one or more entities. For example, a grocery store entity may own and operate buildings 10*a*-10*d* in a particular geographic state. The security systems 302*a*-302*d* may record data from the building subsystems 228 and communicate collected building security data to the cloud server 304.

The cloud server 304 is shown to include a security system 306 that receives the building security data from the security systems 302*a*-302*d* of the buildings 10*a*-10*d*. The cloud server 304 may include one or more processing circuits (e.g., memory devices, processors, databases) configured to perform the various functionalities described herein. The processing circuits may be the same and/or similar to the processing circuit 204, the processor 206, and/or the memory 208 as described with reference to FIG. 2. The cloud server 304 may be a private server. In some embodiments, the cloud server 304 is implemented by a cloud system, examples of which include AMAZON WEB SERVICES® (AWS) and MICROSOFT AZURE®.

In some embodiments, the cloud server 304 can be located on premises within one of the buildings 10*a*-10*d*. For example, a user may wish that their security, fire, or HVAC data remain confidential and have a lower risk of being compromised. In such an instance, the cloud server 304 may be located on-premises instead of within an off-premises cloud platform.

The security system 306 may implement an interface system 308, a site risk analysis system 310, and a historical security database 312 storing historical security data, building security data collected from the security systems 302*a*-302*d*. The interface system 308 may provide various interfaces of user devices 314 for monitoring and/or controlling the security systems 302*a*-302*d* of the buildings 10*a*-10*d*. The interfaces may include various maps, alarm information, maintenance ordering systems, etc.

Security systems, e.g., the security system 302*a*, can protect residential or commercial premises by implementing functionality e.g., intrusion detection, access control, video surveillance, and fire detection. In each case, sensors deployed at various locations in and around the building transmit data back to a central system for analysis, e.g., the security systems 302*a*-302*d*. In some instances, such data is further transmitted to an offsite location that serves as a monitoring center, e.g., the site risk analysis system 310. In either case, the sensor data can be analyzed to determine if a condition exists at the premises that requires attention by a security professional. For example, if a motion sensor detects that someone has entered a building at a time that the intrusion system is armed or if an access control system detects that a door is being forced open, that information is transmitted to the local or remote monitoring center which can deploy security guards or call the police.

Unfortunately, such security systems for detecting alarms (e.g., a fire, an intrusion, etc.) may not be foolproof. Employees can forget to turn on an alarm before leaving for the day or forget to reset an alarm after it is triggered. Further, an alarm system may have faulty devices that cause a building site to be at risk for longer periods of time than normal. For example, a bank may be robbed and a bank teller may trigger an alarm indicating for a police dispatch. After triggering the alarm, the alarm may need to be reset to provide security again. The bank teller may forget to turn on the alarm and leave for the day, causing the bank to be at risk of future robberies and break ins without an active alarm system in place protecting it. Such site risk situations can be numerous and can cause administrators of building sites substantial amounts of money if an event occurs without an alarm going off that was meant to stop the event (e.g., a robbery, a fire, etc.) The long periods of time that particular building sites are at risk can be avoided if administrators can accurately identify which building sites are at risk the most often and what issues are causing the building sites to be at risk. The administrators can then provide the appropriate mechanisms (i.e. employee training, new employees, equipment updates, new equipment, etc.) so the identified building sites can operate without any unnecessary security risks.

In many instances, multiple issues can cause a building site to be at risk within a predetermined time period (e.g., one month). Often, when building sites are at risk, data can be sent to a monitor indicating reasons the building site is at risk, such as, but not limited to, not arming alarms at appropriate times, not resetting alarm equipment, one or more zones being bypassed, communications failures, and/or supervisory equipment failures. However, when multiple building sites experience these issues at the same time, it can be difficult to identify building sites that are at risk the most often and need to be adjusted to improve their security. For example, if 10 building sites are providing security data to a monitoring system, and each building site has had security problems (e.g., times at risk) outside of the building sites normal operating hours, it can be difficult to ascertain the issues and building sites that need to be adjusted. The problem is exacerbated when the security system collects data from building sites indicating time periods that the building sites are supposed to be at risk, such as, for example, when a door alarm is disarmed so customers of a retail store can shop at the store. The security system may need a system or method to determine which building sites are the most at risk and to be able to provide a report indicating how to fix security problems of the building site.

To help the security monitoring system identify and determine building sites that are at risk for security breaches the most often, security system 306 includes site risk analysis system 310, in some embodiments. In some embodiments, site risk analysis system 310 is configured to determine which building sites are "top-offenders," or at risk of a security breach the most often. Site risk analysis system 310 can receive data from security systems of building sites indicating when the building sites are at risk of a security breach and/or when security systems of the building sites are properly armed. Site risk analysis system 310 can determine an average time at risk per day of all of the building sites in communication with site risk analysis system 310. Site risk analysis system 310 can determine a tunable threshold in relation to the determined average. Site risk analysis system 310 can compare the times at risk of each individual building site and flag days that the times at risk exceed the tunable threshold. Site risk analysis system 310 can then provide a report indicating building sites that have the most flagged days and provide the report on a graphical user interface to a user.

In some embodiments, instead of using days that building sites were at risk within a user determined time period to determine building sites that are at risk the most often, site risk analysis system 310 can use a total time at risk over a given time period. Similar to the process described above, site risk analysis system 310 can determine an average time at risk across building sites over the time period and a tunable threshold that is based on the average time at risk across building sites. Site risk analysis system 310 can compare the total time at risk of each building site to the threshold and identify building sites that require attention based on if they were at risk for a time period over the threshold.

In some embodiments, in addition to determining a tunable threshold that applies to all of the building sites, site risk analysis system 310 can determine a tunable threshold that is specific to each building site. In some embodiments, the specific tunable threshold can be the same or similar to the tunable threshold that is applied to all building sites. Site risk analysis system 310 can determine the tunable threshold based on historical security data related to each specific building site. Site risk analysis system 310 can determine an average time at risk for each particular building site and determine a tunable threshold specific to each building site based on how often each site is normally at risk. This is beneficial for building sites that inherently are at risk more often than others (e.g. a 24-hour convenience store compared to a convenience store that is open for 13 hours a day). By determining and generating tunable thresholds specific to each building site, site risk analysis system 310 can identify building sites that are operating out of a normal operation specific to the building site.

Site risk analysis system 310 can implement a counter to determine the number of time each building site is at risk within a given time period. The counter can count the number of days within a time period that a building site is at risk and/or the total time building sites are at risk within a given time period. In some embodiments, the counter can recognize the total time a building site was at risk within a time period. Consequently, an administrator can determine building sites that are the most at risk by analyzing data determined by the counter and the other data provided by site risk analysis system 310.

Figure 4:
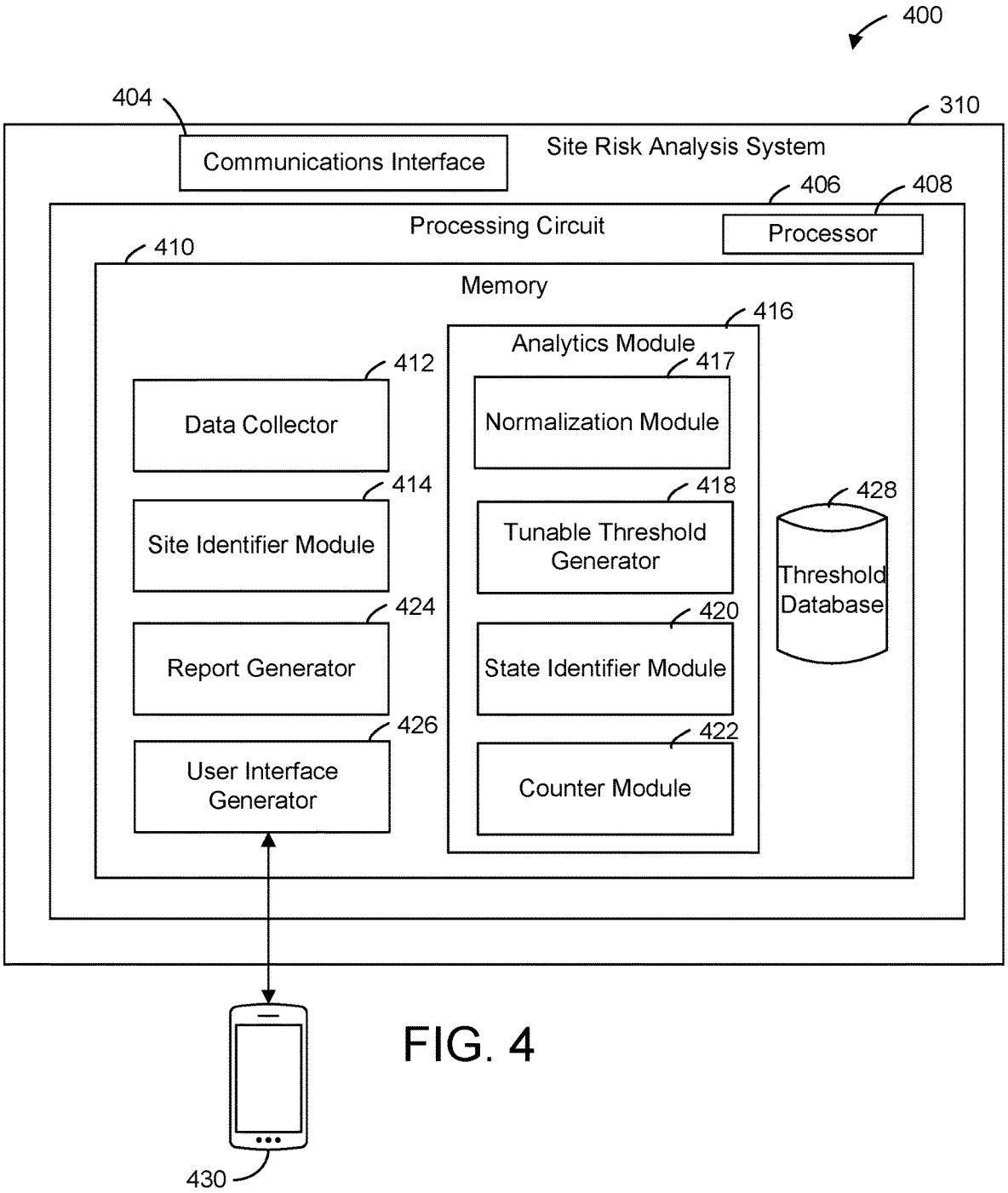
FIG. 4 is a block diagram of a cloud implemented site risk analysis system for analyzing and comparing building data to determine building sites that are at risk, according to an exemplary embodiment.

Referring now to FIG. 4, a block diagram of site risk analysis system 310 as described with reference to FIG. 3 is shown, according to an exemplary embodiment. Site risk analysis system 310 can be configured to identify building sites that are at risk compared to their normal state and/or compared to other building sites within a same security system. In some embodiments, site risk analysis system 310 can also be configured to generate a graphical user interface indicating how often each building site of the building sites are at risk and also indicating how many and what type of false alarms have been triggered at each building site. Site risk analysis system 310 is shown to include a processing circuit 406 that includes a processor 408 and a memory 410. Memory 410 can include instructions which, when executed by processor 408, cause processor 408 to perform the one or more functions described herein. Processor 408 may be the same and/or similar to the processor 206 as described with reference to FIG. 2 and memory 410 may be the same as and/or similar to memory 208 as described with reference to FIG. 2. Each of the processes and services conducted by site risk analysis system 310 can also be conducted by BMS controller 366. In some embodiments, each of the processes and services conducted by site risk analysis system 310 can be implemented in cloud 304, shown and described with reference to FIG. 3, or particularly within site risk analysis system 310.

In addition to a traditional processor and memory, processing circuit 406 may include integrated circuitry for processing and/or control, e.g., one or more processors and/or processor cores (e.g., microprocessor and/or microcontroller) and/or FPGAs (Field Programmable Gate Array) and/or ASICs (Application Specific Integrated Circuitry). Processing circuit 406 can include and/or be connected to and/or be configured for accessing (e.g., writing to and/or reading from) the memory 410, which may include any kind of volatile and/or non-volatile memory, e.g., cache and/or buffer memory and/or RAM (Random Access Memory) and/or ROM (Read-Only Memory) and/or optical memory and/or EPROM (Erasable Programmable Read-Only Memory).

Memory 410 can be configured to store code executable by control circuitry and/or other data, e.g., data pertaining to communication, e.g., configuration and/or address data of nodes, etc. Processing circuit 406 can be configured to implement any of the methods described herein and/or to cause such methods to be performed, e.g., by processor 408. Corresponding instructions may be stored in memory 410, which may be readable and/or readably connected to the processing circuit 406. Memory 410 is shown to include a data collector 412, a site identifier module 414, an analytics module 416, a report generator 424, a user interface generator 426, and a threshold database 428. Memory 410 can include any number of components and/or modules. Processing circuit 406 can implement any of components 412-428 to receive historical building security data indicating when different building sites are at risk, identify different building sites from the historical building security data, determine an average time at risk for each building site, determine a tunable threshold for each building site, determine time periods that exceed the average time and/or tunable threshold, determine building sites that are at risk more often than the other building sites, generate a report indicating the site risk status of each building site, and display the report on a graphical user interface. It may be considered that processing circuit 406 includes or may be connected or connectable to memory 410, which may be configured to be accessible for reading and/or writing by the controller and/or processing circuit 406. Further, components 412-426 of memory 410 can communicate with a user device 430 to receive and transmit data. User device 430 can be the same or similar to user devices 314 as described with reference to FIG. 3.

Site risk analysis system 310 is shown to include a communications interface 404. Communications interface 404 can be configured to facilitate communication with any device. Furthermore, communications interface 404 can be configured to communicate with all of the devices and systems described with reference to FIG. 3. In various embodiments, communications via communications interface 404 can be direct (e.g., local wired or wireless communications) or via a communications network 246 (e.g., a WAN, the Internet, a cellular network, etc.). For example, communications interface 404 can include an Ethernet card and port for sending and receiving data via an Ethernet-based communications link or network. In another example, communications interface 404 can include a Wi-Fi transceiver for communicating via a wireless communications network. In another example, communications interface 404 can include cellular or mobile phone communications transceivers. In one embodiment, communications interface 404 is a power line communications interface and BAS interface 209 is an Ethernet interface. In other embodiments, both communications interface 207 and BAS interface 209 are Ethernet interfaces or are the same Ethernet interface.

Via communications interface 404, historical security database 312 as described with reference to FIG. 3 can be configured to receive (collect) building security data from security systems 302*a-d*. The building security data can include time periods that a building, or building site, is not protected by a security system or a subsystem of the security system and is therefore at risk of an event occurring, such as, but not limited to, a robbery, fire, etc., without an appropriate alarm being triggered. In some embodiments, the building security data is tagged with time stamps indicating times and dates of the time periods that a building site was at risk. The building security data can include current building security data associated with a time period specified by an administrator. The administrator may desire to see how often different building sites are at risk within the time period along with a total time at risk for each building site. Time periods that a building site at risk can be a vulnerable time period where the building site is in an at risk state.

The building security data can also include historical building security data that includes all of, or a portion of, the data sent from security systems 302*a-d* indicating time periods when the building sites associated with security systems 302*a-d* were at risk. The historical security data can include data associated with time periods that a building was intentionally at risk. For example, building historical data can include data indicating that a retail store had its security system turned off during its opening hours between 8 AM and 5 PM Monday through Friday of a specific week. The data can also indicate that one night an employee of the retail store did not turn on the security system after 9 PM and the retail store was therefore at risk throughout the night and into the next day until an administrator, or employee, turned the security system on. The building security data can include historical building data for any number of building sites and/or time periods.

Referring still to FIG. 4, data collector 412 includes program instructions executed by one or more servers or processors (e.g., the processing circuit 406) is shown, in some embodiments. Data collector 412 is configured to retrieve and/or collect building security data from security systems 302*a-d* and store the building security data in historical security database 312, in some embodiments. Data collector 412 can be configured to collect data automatically from security systems 302*a-d* and store the data in historical security database 312, shown and described with reference to FIG. 3. In some embodiments, data collector 412 is configured to poll security system 302*a-d* for data at predetermined time intervals set by an administrator. When collecting data, data collector 412 can be configured to collect the data generated by security systems 302*a-d* after data collector 412 last collected data from associated security systems.

For example, data collector 412 can be configured to collect building security data from security system 302 at 5 PM on a Monday. Data collector 412 can be configured to collect building security data from each security system at two day intervals, so data collector 412 can be configured to collect building security from security system 302*a* again at 5 PM on the Wednesday directly after the Monday. Data collector 412 can be configured to collect data associated with any time period. The building security data collected by data collector 412 on Wednesday can include each time period between Monday at 5 PM and Wednesday at 5 PM that a building site associated with security system 302*a* was at risk. In some embodiments, data collector 412 can be configured to collect a portion of the time periods. Data collector 412 can also be configured to collect building security data indicating time periods that various buildings were not at risk.

Data collector 412 can be configured to tag each time period of the building security data with time stamps indicating when each time period begins and when each time period ends and data of the time periods. In some embodiments, data collector 412 can also tag the data with a site identifier tag indicating which building site the historical building was retrieved from.

In some embodiments, data collector 412 is configured to collect building security data upon receiving a request from an administrator. The administrator may make the request from a user device, such as user device 430. The administrator can request building security data associated with any time period and building site.

In some embodiments, in addition to receiving building security data from security system 302*a-d*, data collector 412 is configured to retrieve building security data from historical security database 312 so components of site risk analysis system 310 can be configured to automatically identify building sites that are at risk based on criteria set by an administrator. An administrator can make a request at a user device, user device 430 for example, to receive site risk information related to any number of building sites. The site risk information can be a report indicating building sites that are at risk as a result of security systems of the building sites not operating as intended. In some embodiments, the administrator can select a time period for site risk analysis system 310 to determine which building sites were at risk within the time period. Data collector 412 can be configured to collect data within the specified time period and provide the data to the components of site risk analysis system 310.

For example, an administrator may request for components of site risk analysis system 310 to determine at risk sites based on data from January. Data collector 412 can be configured to collect the building security data from historical security database 312 associated with time stamps associated with days and/or times in January. Data collector 412 can be configured to provide the data to site identifier module 414 to determine which sites are associated with the data.

Site identifier module 414 includes program instructions executed by one or more servers or processors (e.g., the processing circuit 406), in some embodiments. Site identifier module 414 can be configured to identify building sites associated with the building security data collected by data collector 412. In some embodiments, site identifier module 414 can be configured to identify the sites associated with the building security data by scanning the building security data for tags associated with a site that the building security data was retrieved from. For example, a building site associated with security system 302*a* can provide building security data to site risk analysis system 310 related to time periods that security system 302*a*, and/or components of security system 302*a*, was not monitoring the building site and/or areas within the building site. The building security data may also include time periods that security system 302*a* was operating correctly.

In some embodiments, data collector 412 is configured to receive the time periods of the building security data and tag the time periods with a building site tag (e.g. "building_site_1") indicating which building site the building security data was collected from. Site identifier module 414 can be configured to identify the building sites associated with each time period by scanning the time periods for the building site tags and identifying the tags associated with each time period. Accordingly, site identifier module 414 can be configured to group the data associate with each building site (e.g. organize the data in a table of a database within site risk analysis system 310 based on which building site the data came from) so analytics module 416 can be configured to determine which building sites are at risk the most often.

Referring still to FIG. 4, analytics module 416 can include instructions performed by one or more servers or processors (e.g., processing circuit 406) is shown, in some embodiments. In some embodiments, analytics module 416 is configured to identify how often and/or for how long different building sites associated with site risk analysis system 310 are at risk, or in an unarmed or at risk state, and compare different building sites to each other to identify building sites that are at risk the most often and/or for the longest periods of time. Analytics module 416 can be configured to do so by determining, based on building security data within a user selected time period or based on historical building security data, an average time at risk across each building site associated with site risk analysis system 310, determining normal time periods for a building site to be at risk, (e.g., Monday at 12 PM to 3 PM a door alarm can be off), determining instances that building sites are at risk above the average time at risk across the building sites, determining instances that building sites are at risk above a tunable threshold, and identifying which building sites are at risk the most often and/or for the longest periods of time. To perform these operations, analytics module 416 is shown to include a normalization module 417, a tunable threshold generator 418, a state identifier module 420, and a counter module 422, in some embodiments.

Normalization module 417 can include instructions performed by one or more servers or processors (e.g., processing circuit 406), in some embodiments. In some embodiments, normalization module 417 can be configured to determine an average time at risk across each building site that is in communication with site risk analysis system 310. Normalization module 417 can be configured to determine an average across any number of building sites, including a portion of building sites in communication with site risk analysis system 310. The number of building sites included in the average can be automatically determined by an administrator on a per request basis and/or based on a predetermined setting created by the administrator. Further, normalization module 417 can be configured to determine the average time at risk for building sites within time periods set by an administrator. For example, an administrator may request for data associated with all building sites within a two-month time period, normalization module 417 can determine an average time at risk for all of the building sites within the two-month time period and for time periods within the two-month time period. In some embodiments, normalization module 417 can determine an average time at risk for different time periods within the time periods set by an administrator. For example, normalization module 417 can be configured to determine an average time at risk per day for each particular building site within the time period based on data from within the time period or based on historical data. Normalization module 417 can be configured to determine an average time at risk for time periods of any duration.

In some embodiments, normalization module 417 can be configured to determine the average time at risk for building sites by determining an average time at risk for each building site and then taking an average of the average time at risk for each building site. Normalization module 417 can be configured to determine an average time at risk for each building site by receiving data from data collector 412 with building sites identified by site identifier module 414, identifying all of the data associated with each building site, and determining the average time at risk for each building site. Normalization module 417 can be configured to determine the average for a building site by identifying time periods that the site was at risk within a time period set by an administrator and determining durations for each time period (e.g., a day, a week, etc.). Normalization module 417 can be configured to determine durations of time periods by comparing time stamp tags associated with each time period. Normalization module 417 can be configured to aggregate the time periods that the building site was at risk to obtain a total time at risk for the building site and divide the total time risk by the total time of the administrator selected time period. Normalization module 417 can be configured to repeat this process for each building site identified or selected by the administrator to obtain average times at risk for each building site. Normalization module 417 can be configured to obtain an average time at risk across all of the building sites by aggregating the average times at risk of each building site and dividing the times at risk by the number of building sites associated with the aggregated time. Normalization module 417 can be configured to obtain an average time at risk for any number of building sites. Advantageously, by determine the average time at risk for each building site to determine the average across all building sites, site risk analysis system 310 can be configured to provide an average for each building site to a user via a report generated by site risk analysis system 310.

In some embodiments, instead of determining average times at risk for each building site, normalization module 417 can be configured to obtain average times at risk across all of the building sites by aggregating all of the time the building sites were at risk within a time period together to obtain an aggregated time and dividing the aggregated time by the total number of building sites to obtain an average time at risk per building site. Normalization module 417 can be configured to obtain an average time at risk for building sites using any method.

In some embodiments, building sites in communication with site risk analysis system 310 can be grouped by type of building site and normalization module 417 can be configured to determine average times at risk based on building site type. Each building site type may operate to perform the same function. For example, a retail company may have different building site types such as, but not limited to, stand-alone retail stores, strip-mall stores, warehouses, corporate buildings, etc. An administrator may wish to only compare time at risk between building sites that have the same building site type to more easily identify particular building sites that are operating at risk more often than other similar building sites. A user or an administrator can select one or more building site types and send a request to site risk analysis system 310 for building security data associated with the one or more specific building site types. Normalization module 417 can be configured to store any average times at risk determined by normalization module 417 in threshold database 428.

Further, in addition to determining the average time at risk across building sites, normalization module 417 can be configured to determine a standard deviation associated with the determined average. Similar to the average times at risk for smaller time periods within an administrator selected time period, standard deviations can be determined for the smaller time periods in addition to the administrator selected time period. The standard deviation can be determined by the equation:

$$\text{Standard Deviation} = \sqrt{\frac{\Sigma(x-\bar{x})^2}{n}}$$

x=average time at risk of a particular building site.
$\bar{x}$=average time at risk of all of the building sites.
n=number of building sites included in the data.

Normalization module 417 can be configured to implement the equation above to determine the standard deviation of the building data. Normalization module 417 can be configured to send determined standard deviations and building site averages to threshold database 428 and/or any other components of site risk analysis system 310.

Threshold database 428 can be a dynamic database including data inputs generated by tunable threshold generator 418 and normalization module 417 of analytics module 416. Threshold database 428 can be a graph database, MySQL, Oracle, Microsoft SQL, PostgreSql, DB2, document store, search engine, key-value store, etc. Threshold database 428 is configured to hold any amount of data and can be made up of any number of components, in some embodiments. Threshold database 428 can be configured to store average times at risk for particular building sites, average times at risk across multiple building sites, and standard deviations associated with each of the averages. Threshold database 428 can also be configured to store tunable thresholds for each particular building site as calculated by tunable threshold generator 418 or any other component or module that determines tunable thresholds. Threshold database 428 can be configured to store multiple averages and tunable thresholds for each building site and across building sites based on different time periods. Threshold database 428 can be configured to store any number of thresholds. Further, thresholds can be added or removed from threshold database 428 at any time.

Tunable threshold generator 418 can include instructions performed by one or more servers or processors (e.g., processing circuit 406), in some embodiments. In some embodiments, tunable threshold generator 418 is configured to determine tunable thresholds. Tunable thresholds can be thresholds that site risk analysis system 310 implements to identify at risk building sites by identifying when particular building sites are at risk for time periods above the tunable threshold. In some embodiments, tunable thresholds are thresholds above the average across all building sites determined by normalization module 417. For example, normalization module 417 can be configured to determine that the average building site of a group of building sites is in at risk state for 11 hours a day. Tunable threshold generator 418 can be configured to determine and generate a tunable threshold indicating that building sites are at risk for days the building sites are at risk for 13 hours or more. The tunable threshold would be 13 hours, or two hours above the average. Tunable thresholds can be manually determined by an administrator or automatically determined by tunable threshold generator 418. Further, tunable thresholds can be particular to each building site based on historical building security data, as will be described below.

In some embodiments, tunable threshold generator 418 is configured to determine tunable thresholds based on standard deviations of the average time at risk across building sites determined by normalization module 417. An administrator can provide an input to site risk analysis system 310 identifying a tunable threshold based on a multiple of a standard deviation determined by normalization module 417. For example, an administrator can request for the tunable threshold to be two standard deviations above the average across all building sites. Tunable threshold generator 418 can be configured to receive the request and retrieve, or receive, standard deviation data and average time at risk across all building sites from threshold database 428 and/or normalization module 417. Tunable threshold generator 418 can be configured to identify the average time at risk across all building sites and generate a tunable threshold by adding two standard deviations to the average time at risk. Tunable threshold generator 418 can be configured to store tunable thresholds in threshold database 428. Administrators can request and tunable threshold generator 418 can be configured to generate tunable thresholds based on any value in comparison to the average time at risk across building sites. In some embodiments, tunable thresholds can be applied to all building sites being analyzed. Further, tunable thresholds can be below, above, or equal to the average time at risk across building sites.

In some embodiments, tunable threshold generator 418 can be configured to determine tunable thresholds for individual building sites. This is advantageous if an administrator believes particular building sites need to be more or less secure than other building sites. Continuing with the example above, an administrator may request that building site A be determined to be at risk if building site A is vulnerable for a time period one standard deviation above the average time at risk across all building sites. The administrator can also request that building site B be determined to be at risk if building site B is vulnerable for a time period three standard deviations above the average across all building sites. In this example, a tunable threshold associated with building site A can be one standard deviation above the average across building sites and a tunable threshold associated with building site B can be three standard deviations above the average across building sites. The other building sites of the building sites can be associated with the same tunable threshold of two standard deviations of the average across building sites or be associated with their own particular tunable thresholds. Any number of building sites can be associated with a particular tunable threshold to each building site.

In some embodiments, tunable threshold generator 418 can be configured to determine and generate tunable thresholds for particular building sites based on historical building security data. For example, tunable threshold generator 418 can be configured to retrieve historical security building data for a building site from historical security database 312 indicating that, during normal operation within a predetermined time period, the building site is in an at risk state for 13 hours a day. The average vulnerable time periods across building sites may be 10 hours a day. If an administrator requests for site risk analysis system 310 to determine that building sites are at risk if they are vulnerable for a time three standard deviations above the average, tunable threshold generator 418 can be configured to identify that the building is normally in an at risk state for 13 hours a day and determine a tunable threshold three standard deviations above the determined 13 hours a day average specific to the building site instead of the 10 hours a day determined based on the average across all building sites. Tunable threshold generator 418 can be configured to identify tunable thresholds particular to any number of building sites.

Similarly, tunable threshold generator 418 can be configured to generate tunable thresholds specific to a building site type. Similar to above, an average historical vulnerability time can be determined by tunable threshold generator 418 for building sites in communication with site risk analysis system 310 within a building site type. Tunable threshold generator 418 can generate a tunable threshold specific to the building sites of the building site type. For example, if a retail store has a storage building type and a retail building type, tunable threshold generator 418 can be configured to generate a tunable threshold specific to building sites of the storage building sites. Tunable threshold generator 418 can be configured to generate tunable thresholds for any group of building sites.

State identifier module 420 includes instructions performed by one or more servers or processors (e.g., processing circuit 406), in some embodiments. State identifier module 420 can be configured to identify instances that a vulnerability time period exceeds a tunable threshold generated by tunable threshold generator 418. In some embodiments, an instance is a day within an administrator selected time period that a particular building site exceeds a tunable threshold. State identifier module 420 can be configured to identify days that building sites exceed the tunable threshold by receiving data collected and tagged by data collector 412 and site identifier module 414 and determining a vulnerability time period for each site for each day based on the tagged data. State identifier module 420 can be configured to calculate a vulnerability time period for each day for each building site and compare a duration of each vulnerability time period to tunable thresholds associated with each building site. State identifier module 420 can be configured to identify and flag days that durations vulnerability time periods exceed a tunable threshold associated with a building site.

In some embodiments, to determine vulnerability time periods of a building site for a particular day, state identifier module 420 can be configured to identify each time period within the particular day that the building site was at risk. Each building site can be at risk based on different risk types. For example, risk types can include, but are not limited to, one or more security subsystems not being armed, one or more pieces of equipment not being reset after an alarm, one or more zones being bypassed, one or more communication failure events, or one or more supervisory system failure events. State identifier module 420 can be configured to determine time periods associated with each risk type and aggregate the time periods together to obtain a vulnerability time period. State identifier module 420 can be configured to obtain vulnerability time periods for a building site for every day (or requested specific days) within a time period. Further, state identifier module 420 can be configured to obtain vulnerability time periods for each building site in communication with site risk analysis system 310 and/or building sites as specified by an administrator.

In some instances, multiple risks types may cause a building site to be at risk during the same time period. To avoid double counting for the total time that a building site is at risk, state identifier module 420 can be configured to identify the overlapping time periods at risk and only associate one time period with the overlapping times when aggregating the times at risk of the different risk types. Consequently, state identifier can obtain an accurate measurement of a vulnerability time at risk of a building site for a day while still tracking the time periods that different risk types caused the building site to be at risk.

State identifier module 420 can be configured to compare the determined vulnerability time periods for each building site to tunable thresholds associated with each site. If state identifier module 420 determines that a vulnerability time period of a building site has a duration above a tunable threshold associated with the building site for a day, state identifier module 420 can be configured to tag the day with a tag indicating the building site was in an at risk state on that day. If state identifier module 420 determines a building site was not at risk for a day, state identifier module 420 can be configured to tag the day with a tag indicating the building site was "good" on that day. State identifier module 420 can be configured to determine days that building sites are at risk for any number of days and for any number of building sites.

Counter module 422 is instructions performed by one or more servers or processors (e.g., processing circuit 406), in some embodiments. Counter module 422 can be configured to identify days that state identifier module 420 tagged as days that a particular building site is at risk. Counter module 422 can be configured to store and increment a counter for a building site each day that state identifier module 420 identifies a building site to be at risk. Counter module 422 can also be configured to store and increment a counter for a day a building site was not determined to be at risk, or the building site was good. Counter module 422 can be configured to store and increment counters for any number of building sites.

In some embodiments, instead of or in addition to incrementing counters every day that a building site is determined to be at risk or good, counter module 422 can be configured to track a total number of hours that each building is at risk within a user specified time period. Counter module 422 can be configured to track the total amount of hours associated with specific types of risks that cause a building site to be in an at risk state and/or a total number of hours the building site is in an at risk state. Counter module 422 can be configured to track time that particular building sites are in an at risk state for any number of building sites. Counter module 422 can be configured to send and update any counters counter module 422 has been updating to report generator 424 either upon request from an administrator or automatically at a predetermined time period.

Report generator 424 includes programmed instructions executed by one or more servers or processors (e.g., processing circuit 406), in some embodiments. Report generator 424 can be configured to generate reports based on the building security data collected by data collector 412 and/or the processes that were used to determine which building sites were at risk the most often and/or for the longest periods of time within an administrator selected time period. Reports can be data collected and generated by components 412-422 and organized into a display as specified by an administrator (e.g., graphs, tables, summaries for each building site, etc.) In some embodiments, report generator 424 can be configured to generate a report for one or more building sites selected by an administrator. The report can include data for any number of building sites. The report can be a comparison between the building sites and how often and/or how long each building site was in an at risk state within a time period selected by the administrator. Report generator 424 can be configured to generate a report for any time period.

In some embodiments, report generator 424 can be configured to generate a report showing how many days particular building sites were in an at risk state above a threshold and how many days the building sites had alarms that were properly armed throughout the day. As described above, analytics module 416 can be configured to determine a "normal" operation of a building security system for each day (e.g. a building site may normally be armed for 11 hours a day) and then identify days where the building site is armed for less time. Counter module 422 can be configured to increment a counter every day the building site is armed for time below a threshold (or at risk for a time above a threshold) and another counter every day the building site is armed as it normally is. Report generator 424 can be configured to generate a report including the data determined by analytics module 416 including counter module 422.

In some embodiments, instead of or in addition to providing days at risk in reports, report generator 424 can be configured to provide a total time length each building site was at risk within a time period specified by an administrator. Counter module 422 can be configured to aggregate the total time the building site was at risk across days of an administrator selected time period (e.g., one week, one month, etc.) and report generator 424 can be configured to provide the total time determined by counter module 422. In some embodiments, report generator 424 can be configured to include multiple counters for each building site, each counter corresponding to a different risk type of a security system of a building site that was at risk (e.g., one of one or more security subsystems not being armed, one or more pieces of equipment not being reset after an alarm, one or more zones being bypassed, one or more communication failure events, one or more supervisory system failure events, etc.). The report can include a total time at risk for each risk type along with a total time that includes an aggregation of the times at risk for each risk type. Further, report generator 424 can be configured to generate a total time at risk for each day and/or for a given time period.

In some embodiments, the report only includes a total time at risk of the building system based on non-overlapping times at risk for each risk type. For example, if multiple components of a building security system (e.g., building security systems 302*a-d*) are not armed properly at the same time (e.g., a communication failure and a zone bypassed at the same time), report generator 424 can be configured to include the time at risk for each component in a report, but only include one instance of the security system being at risk when showing a total time period that a building site was in an at risk state. Consequently, administrators viewing reports generated by report generator 424 can see a total time a building site was at risk (without any overlap caused by multiple risk types being present at the same time) along with a counter for different risk types that are causing the building sites to be at risk.

In some embodiments, reports generated by report generator 424 include data identifying a normal time at risk across building sites that are in communication with a security system. The report can include an average time at risk across building sites as determined by analytics module 416 along with average time at risk for each individual building site. The report can also include information about a standard deviation of each of the averages.

In some embodiments, reports generated by report generator 424 include identifications of identifying "abnormal sites" or sites that are determined to be at risk more often than an administrator would prefer based on tuned thresholds. In the reports, report generator 424 can be configured to include a net time at risk and/or a daily time at risk for each building site. A user can request a report for different building sites for any time period (e.g., one month) and report generator 424 can be configured to identify and display a total time at risk and/or a total days at risk within the time period and for each of the different building sites. Report generator 424 can be configured to do so using data collected and determined by components 412-416 of site risk analysis system 310. In some embodiments, report generator 424 can display days at risk with an illustration of a calendar as will be shown and described with reference to FIG. 7.

In some embodiments, reports generated by report generator 424 include identifications of building sites that are "top-offenders" or building sites that are at risk for the longest periods of time and/or for the most days within an administrator selected time period. In some embodiments, an administrator selects a number of building sites to be reported as top-offenders and report generator 424 displays the building sites associated with the most time at risk or that had the most days at risk within an administrator selected time period. For example, an administrator can determine that the four building sites with the most days at risk can be classified as top-offenders. Report generator 424 can be configured to display the four building sites with the most days at risk as top-offenders in a report. Further, report generator 424 can be configured to include a recommendation in a report indicating which building sites are the most at risk and need to be addressed.

In some embodiments, report generator 424 can also include identifications of building sites with unusually low times at risk and display the building sites in a report. For example, a building site alarm may be armed 20 hours a day every day for a month while alarms of other building sites are only armed for 11 hours a day. Report generator 424 can be configured to identify the building site that is armed significantly more than other building sites in a report. This is advantageous because similar to building sites that are not armed enough, building sites that are armed too much may not working properly or the data may be inaccurate. An administrator may see the building site that was armed more than the others and be able to investigate any causes.

User interface generator 426 includes instructions executed by one or more servers or processors (e.g., processing circuit 406), in some embodiments. User interface generator 426 can be configured to generate a user interface to send to user devices, such as user device 430, and update the user interface with data collected and determined be components 412-422 of site risk analysis system 310 and reports generated by report generator 424. In some embodiments, user interface generator 426 is a communication interface between site risk analysis system 310 and different user devices. A user at a user device in communication with site risk analysis system 310 can send requests (e.g., push requests generated by pushing on different points on a graphical user interface generated by user interface generator 426) to user interface generator 426 asking for different types of data (e.g., data specific to different building sites, data specific to different time periods, etc.). In some embodiments, users can request data specific to different risk types that are present at different building sites and compare data related to different building sites against each other. In some embodiments, users can also request data related to causes of false alarms and/or police dispatches at different building sites.

Upon receiving requests from a user device at user interface generator 426, user interface generator 426 can be configured to send a signal corresponding to the request to components 412-424 of site risk analysis system 310 to generate a report based on the request. As described above, components 412-424 can cooperate to generate a report including data corresponding to how long different building sites are at risk and identifying which building sites are in an at risk state the most often. User interface generator 426 can be configured to update a graphical user interface with the report. After receiving the report at the graphical user interface, a user, such as, but not limited to, an owner of a company, can identify building sites that need to operate differently (e.g., employees need to remember to turn on alarms correctly, faulty equipment needs to be improved, etc.).

In some embodiments, if a report generated by report generator 424 indicates conditions that a building security system can automatically improve (e.g., parameters of sensors can be adjusted, a controller controlling the security sensors can be updated, etc.), report generator 424 can be configured to send a signal to the building system with instructions on how to improve the security of the building. Consequently, the building security system can automatically "heal" itself so a building site associated with the building security system can become more secure.

Advantageously, by using time based data, site risk analysis system 310 can automatically identify building sites that are at risk more often than an administrator deems appropriate and provide a report indicating that action can be taken to improve security of the identified building sites. If site risk analysis system 310 determines that a security system can automatically fix the problem, site risk analysis system 310 can automatically send a signal to the security system of the building site so the security system can adjust the appropriate parameters and the building site can be in in an at risk state less often. Consequently, each building site of a security system can be more secure against fire and security risks as administrators can identify what is causing the risks to fix them and/or the security systems can automatically fix problems in a security system of a building site that could be causing fire and/or security risks.

Figure 5:
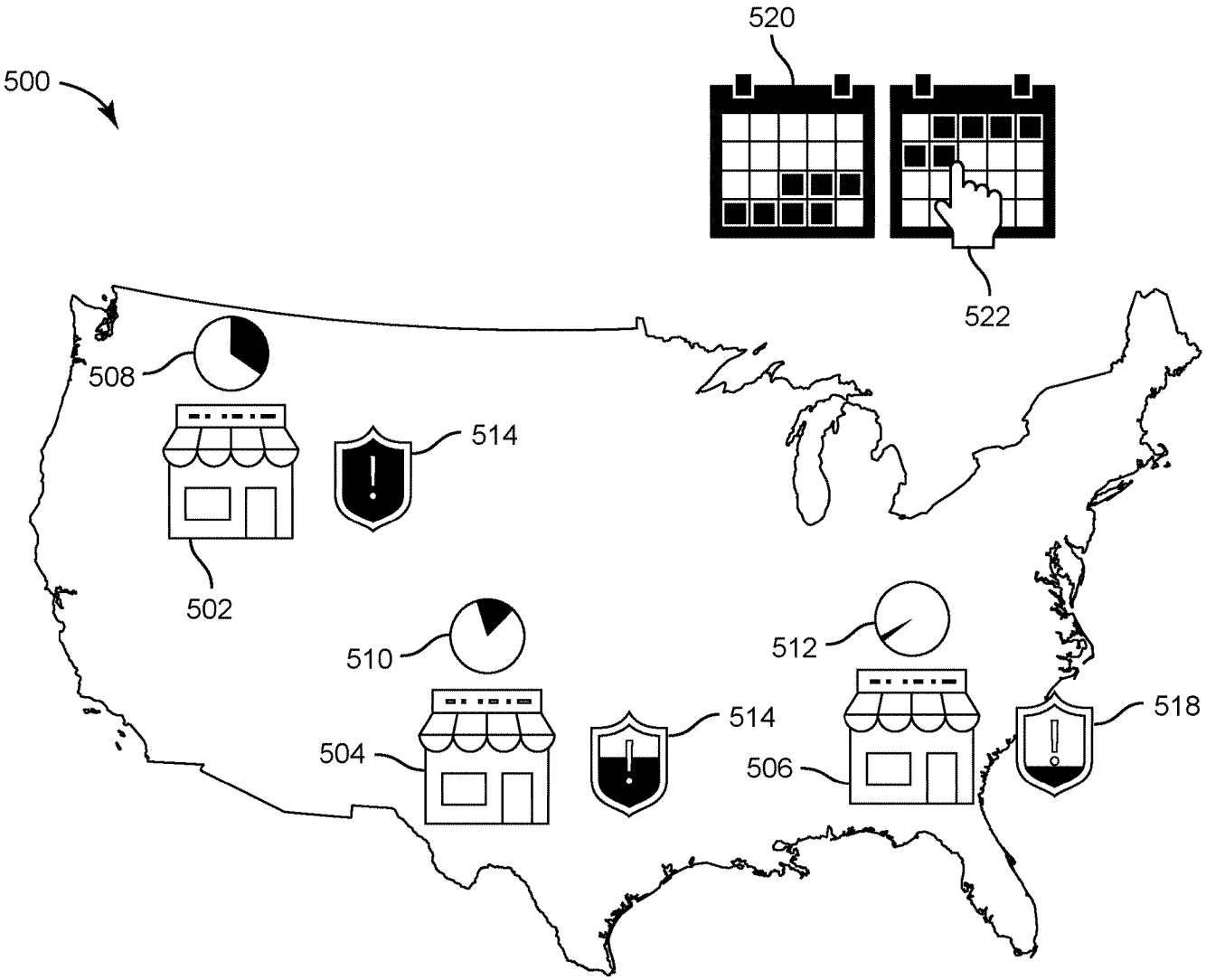
FIG. 5 is an illustration of multiple building sites located at different locations and indicators indicating how often each site is at risk, according to an exemplary embodiment.

Referring now to FIG. 5, an illustration of a map 500 of the United States including different building sites is shown, in some embodiments. Map 500 is shown to include building sites 502, 504, and 506. Each of building sites 502, 504, and 506 can be associated with a site risk score as illustrated in performance pie charts 508, 510, and 512. Further, each of building sites 502, 504, and 506 can be associated with corresponding performance graphics 514, 516, and 518 illustrating how secure each building site is. Also included in map 500 is an illustration of a user selected date range 520 selected using a cursor 522. Building sites 502, 504, and 506 can be representative of different building sites that provide security data to site risk analysis system 310. Each building site can be associated with a security system that monitors building security data (e.g., time periods each alarm is armed and time periods that one or more alarms is not armed) of the building site. Building sites 502, 504, and 506 can transmit building security data to site risk analysis system 310 to determine which building site is the most at risk and/or which building sites are operating properly.

To generate map 500 with data illustrating a site risk for each of building sites 502, 504, and 506, map 500 is shown to include user selected date range and cursor 522. User selected date range 520 is shown to be a calendar that a user can click on to generate data corresponding to a date range of the calendar. For example, a user may use cursor 522 to click on two dates on a map shown on a user interface generated by user interface generator 426. The first date can be a starting date and the second date can be an ending date of a request sent to site risk analysis system 310 to generate data. Site risk analysis system 310 can identify the user requested date ranges and determine days at risk and total time at risk within the date range selected by the user for different building sites using the system and method described herein. Site risk analysis system 310 can update map 500 with data for each building site indicating which building sites are at risk based on a user selected criteria (e.g., total time at risk, total days at risk, etc.). Site risk analysis system 310 can display the data using performance pie charts 508, 510, 512 and/or performance graphics 514, 516, and 518 or through any other graphic or chart.

Performance pie charts 508, 510, and 512 can be illustrations indicating days at risk for multiple building sites. Performance pie chart 508 is shown to be associated with building site 502. Performance pie chart 510 is shown to be associated with building site 504, and performance pie chart 512 is shown to be associated with building site 506. Performance pie charts can be associated with any building site. In some embodiments, the gray portions of performance pie charts 508, 510, and 512 are representative of days where security systems of associated building sites are armed properly and the white portions are representative of days where the sites are at risk. Accordingly, the more often a building site is armed properly throughout the day, the more full (or more gray) an associated performance chart appears. The more often a building is not armed properly throughout the day, however, the less full an associated pie chart appears.

Performance graphics 514, 516, and 518 are shown to be full corresponding to how full each of performance pie chart 508, 510, and 512 is, in some embodiments. Similar to their corresponding performance pie charts 508, 510, and 512, performance graphics 514, 516, and 518 can be representative of how much time building sites, such as building sites 502, 504, and 506, are at risk within a user determined time period. The performance graphic that is shown to be the fullest is the site at risk the least while the performance graphic that is shown to be least full is the site at risk the most, in some embodiments. Consequently, of the building sites of map 500, building site 506 is shown to be the most at risk because performance graphic 518 is the most full while building site 502 is shown to be the least at risk per performance graphic 514.

Figures 6A, 6B:
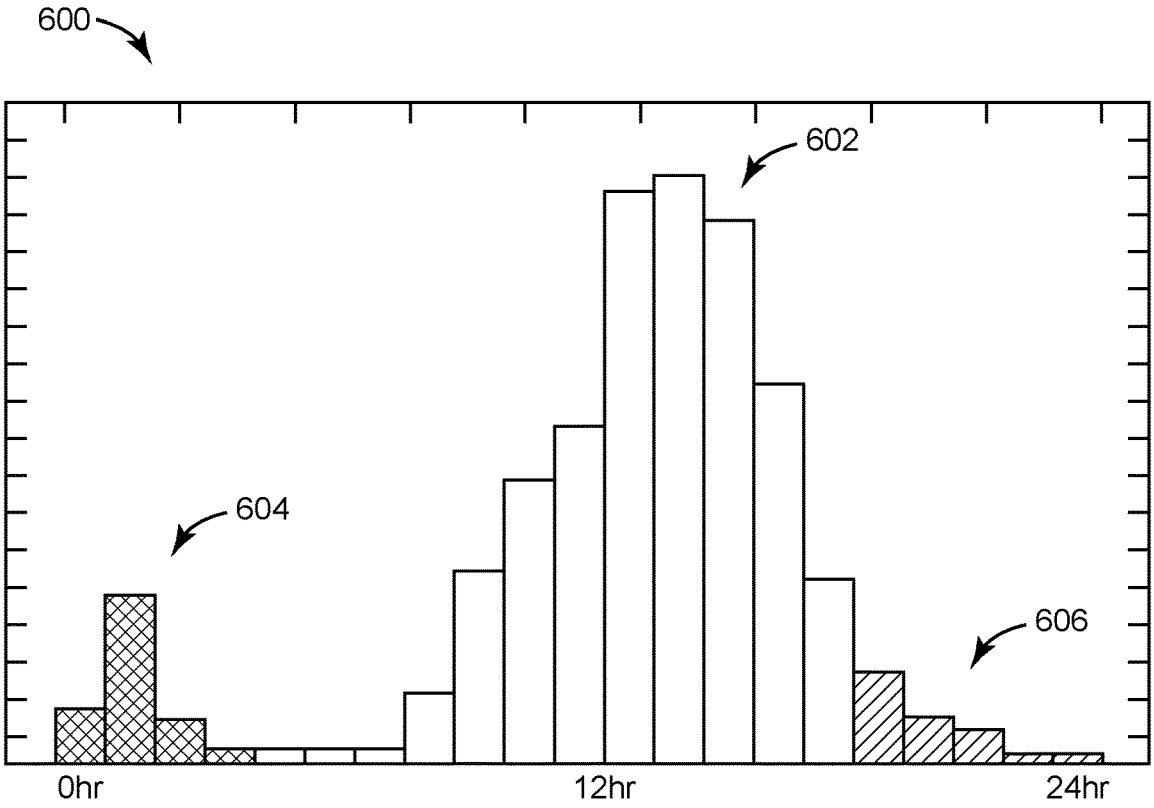
FIG. 6A is a histogram illustrating how often building sites are at risk on a daily basis, according to an exemplary embodiment.
FIG. 6B is a table illustrating a security system status of a store throughout a day, according to an exemplary embodiment.

Referring now to FIG. 6A, a histogram 600 of how much time building sites in communication with a building security system are at risk per day is shown, according to some embodiments. Histogram 600 is shown to include 24 bars, each bar representing a number of hours different building sites spent at risk during a day within a user selected time period. Histogram 600 is shown to include bars for a typical time range 602, a too-low time range 604, and a top offenders time range 606, in some embodiments. Typical time range 602 can include data that an administrator determines appropriate for building sites to be in an at risk state. Administrators can adjust the time range to any times of their choosing. For example, an administrator may adjust the typical time range to be hours of operation of an associated business. Too-low time range 604 can include days that particular building sites were at risk for an unusually low time period. This data is useful to help flag security systems that may not be working properly or businesses that are not operating as often as they should be if alarms are always armed. Finally, top offenders time range 606 can include days that building sites spent more time at risk than an administrator deems appropriate, above a tunable threshold, for example. Building sites can be included in data points associated with any of the bars of histogram 600.

Referring now to FIG. 6B, a table 608 illustrating a security system status of a store throughout a day is shown, according to some embodiments. Table 608 includes a time column 610 and a status column 612. Time column 610 includes time stamps indicating times that the status of a security system of a store changed configuration or experienced a failure event, in some embodiments. In some embodiments, the configuration of the security system of the store remains the same until another configuration changes or a failure event occurs. Status column 612 includes descriptions of events that cause a configuration or status of a security system to change with a corresponding time of the change in time column 610. For example, at 9:30 PM there was a communication failure that caused the store to be at risk. At 10:30 PM, communications were restored and the security system was rearmed. Site risk analysis system 310 could determine that the store was at risk between 9:30 and 10:30 PM, or at risk for one hour. Site risk analysis system 310 could determine the store was at risk for 14 hours of the described day and secure for the other 10 hours. Consequently, if the store was included in histogram 600, shown and described with reference to FIG. 6A, the day of the store would be included in the bar associated with sites at risk for 14 hours, in some embodiments.

Referring now to FIG. 7, a calendar 700 illustrating days of December and how long a security system of a building site was armed for each day of December is shown, according to some embodiments. Calendar 700 is shown to include alarm armed data for 31 days for one building site. Calendar 700 is shown to include a standard alarm armed day 702 and two days 704 and 706 where the building site was at risk because an alarm was armed for a small time period. Standard alarm armed day 702 is shown to be armed for 11 hours, similar to most of the other days shown in calendar 700. Consequently, site risk analysis system 310 can determine that the building site is not at risk on standard alarm armed day 702 or any day that a security system of the building site is armed for a similar or the same amount of time. A building site can be armed for a similar amount of time if the building site is armed within a range set by an administrator or armed for a time period above a tunable threshold (and consequently not armed for a time period below the tunable threshold).

Days 704 and 706 are representative of days that alarms of a building site were not armed for a proper amount of time, or for a time period above a threshold. At day 704, the building site is shown to only have been armed for four hours, and at day 706, the building site is only shown to have been armed for 20 minutes. While a value of a tunable threshold is not shown, the alarm armed time is below the other days which averaged an alarm armed time of 11 hours per day. Site risk analysis system 310 can be configured to identify days 704 and 706 as days the building site was at risk and increment a counter for each of days 704 and 706 indicating the building site was at risk twice in December. In some embodiments, instead of incrementing a counter associated with the days at risk, site risk analysis system 310 can increment a counter associated with the total time at risk for each day. For example, day 704 was at risk for 20 hours and day 706 was at risk for 23 hours and 40 minutes. Site risk analysis system 310 increment the counters associated with each time frame so the counter would increase by 43 hours and 40 minutes for the two days. Site risk analysis system 310 can display the results of the incremented counter by updating a graphical user interface showing time at risk of the building site.

Figure 8:
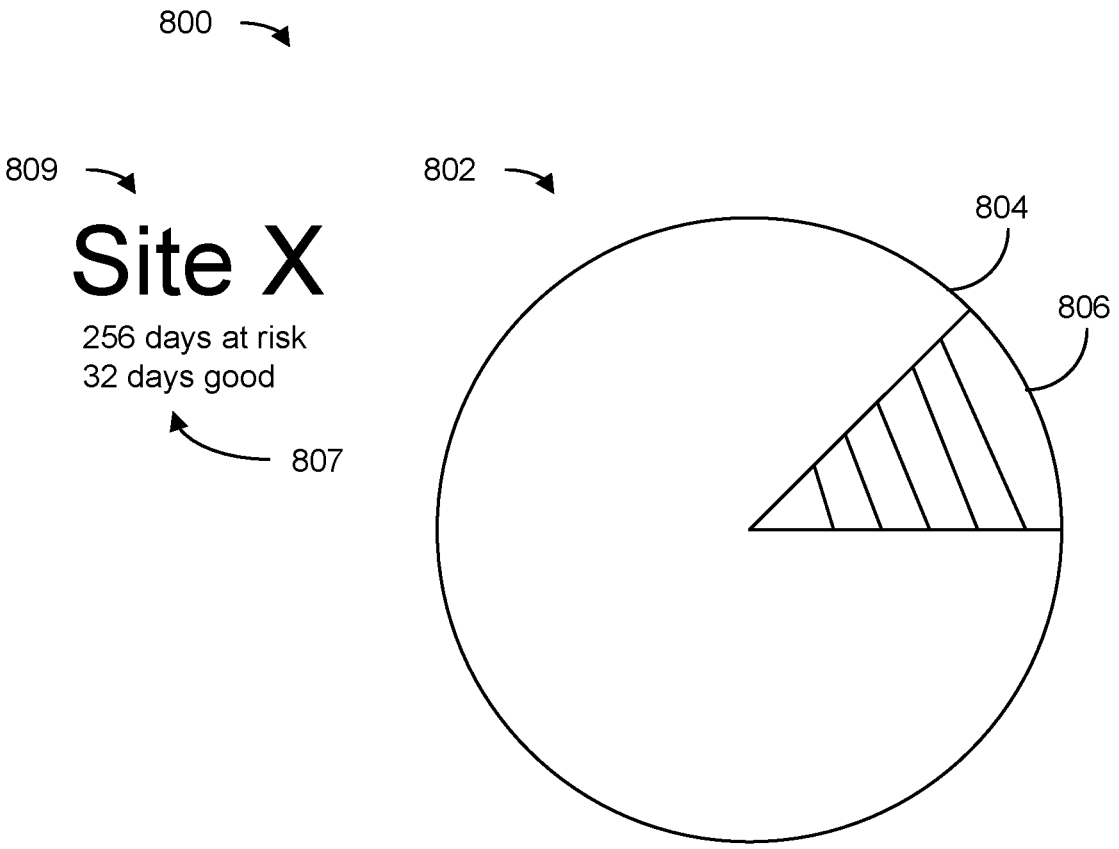
FIG. 8 is a graphic illustrating how often a particular building site is at risk within a predetermined time period, according to an exemplary embodiment.

Referring now to FIG. 8, a graphic 800 illustrating how many days a building site, site X, was at risk within a 288-day time period is shown, in some embodiments. Graphic 800 can be generated by graphical user interface generator 426 of site risk analysis system 310 to show data collected and analyzed by components 412-416 of site risk analysis system 310. Graphic 800 is shown to include a performance pie chart 802, data 807, and a label 809 identifying site X as the building site the data is for. Performance pie chart 802 can be the same as or similar to performance pie charts 508, 510, and 512 as shown and described with reference to FIG. 5.

Performance pie chart 802 is shown include a days at risk section 804 and a days good section 806. Days at risk section 804 can represent a portion of the days of a time period that building site X was at risk for a time period at or above a tunable threshold and days good section 806 can represent a portion of the days of the same time period that building site X is at risk within an acceptable time period, or a time period below the tunable threshold. The days represented in performance pie chart 802 are shown to include data 807. A label identifying the building site that the data is associated with (e.g., site X) is label 809, in some embodiments. Performance pie chart 802 can display data in any form and for any building sites.

Figure 9:
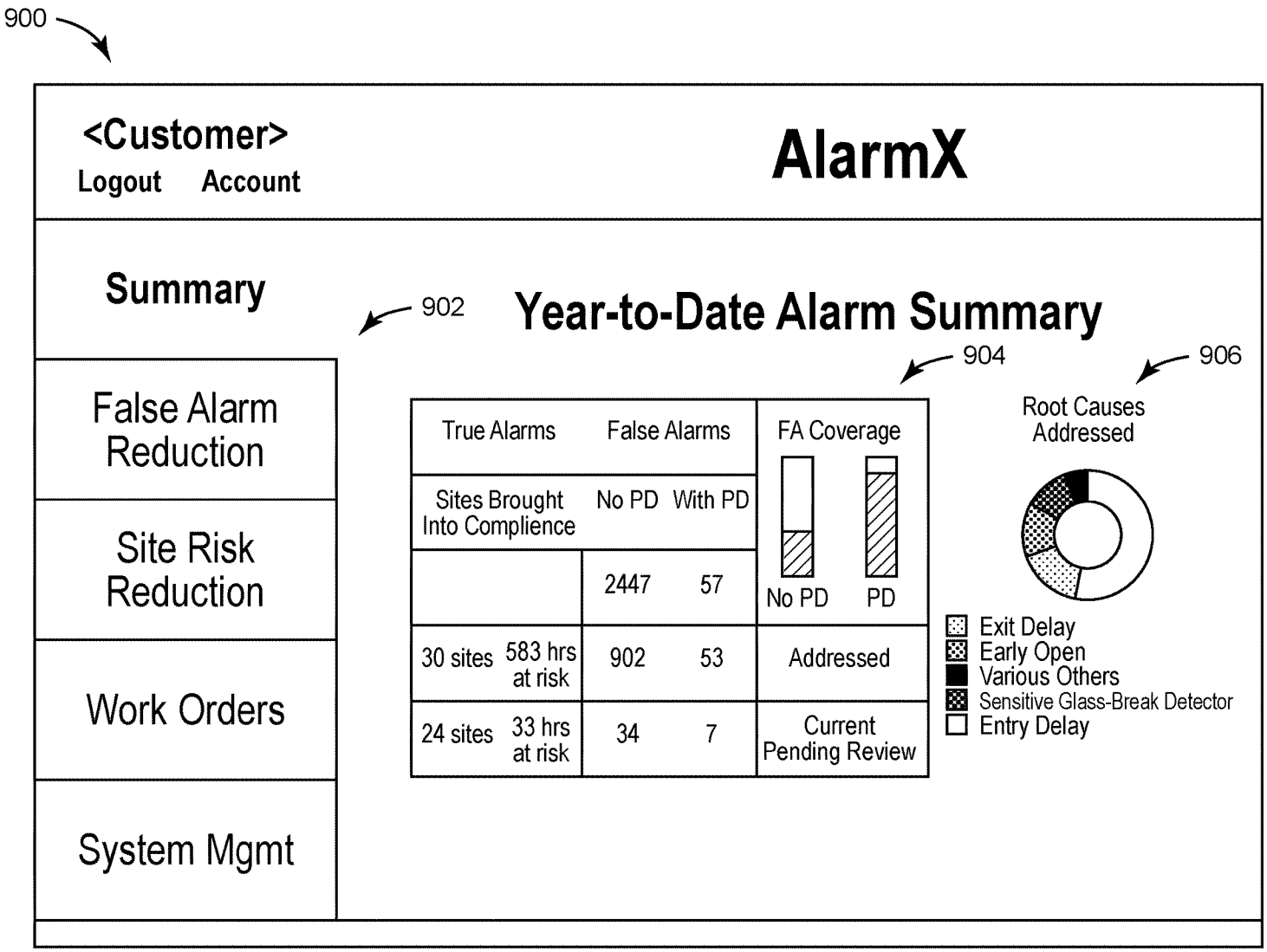
FIG. 9 is a graphical user interface illustrating a summary of data indicating how often false alarms are being triggered at multiple building sites, what caused the false alarms, and how often different building sites were at risk within a time period, according to an exemplary embodiment.

Referring now to FIG. 9, a graphical user interface 900 illustrating a year to date alarm summary is shown, according to some embodiments. Graphical user interface 900 can be generated by user interface generator 426 of site risk analysis system 310 to display a summary of site risk analysis results generated by site risk analysis system 310 and root cause data generated by another component (not shown) of cloud server 304, shown and described with reference to FIG. 3. Graphical user interface 900 is shown to include an option panel 902, a summary chart 904, and a root causes addressed chart 906. A user can press on any of components 902-906 and/or portions of components 902-906 to request more data from site risk analysis system 310 or other systems of cloud server 304.

Option panel 902 is shown to include options that a user can select to view different data of a building site or groups of building sites. A user can select to view summary data, false alarm reduction data, site risk reduction data, work orders data, and/or system management data, in some embodiments. Graphical user interface 900 shows what a user could view by clicking on the summary option of option panel 902.

Summary chart 904 is one or more charts showing analytics of multiple building sites in communication with a security system and/or cloud server 304 and its components therein, such as site risk analysis system 310, in some embodiments. Summary chart 904 is shown to include data related to true alarms that were raised within a user selected time period and at one or more building sites, false alarms that were raised, the number of police dispatches resulted from a false alarm, the number of police dispatches that were not called even though there was a false alarm, and site risk analysis regarding how long different building sites were at risk based on a security system. Data correlated to site risks of user interface 900 can be received from site risk analysis system 310 and data correlated to false alarm data can be received from another component of cloud server 304 and/or site risk analysis system 310. Summary chart 904 can show data associated with any number of building sites.

Root causes addressed chart 906 is a chart showing root causes of false alarms that go off at building sites that are associated with data collected by components of cloud server 304. Root causes addressed chart 906 shows different types of root causes that are triggered at different building sites and percentages associated with each root cause against each other. Root causes addressed chart 906 is shown to be a donut chart comparing percentages of root cause types against each, but root causes addressed chart 906 can be any type of chart. In some embodiments, root causes addressed chart 906 can show the total number of root causes instead of percentages of root causes compared to each other.

Figure 10:
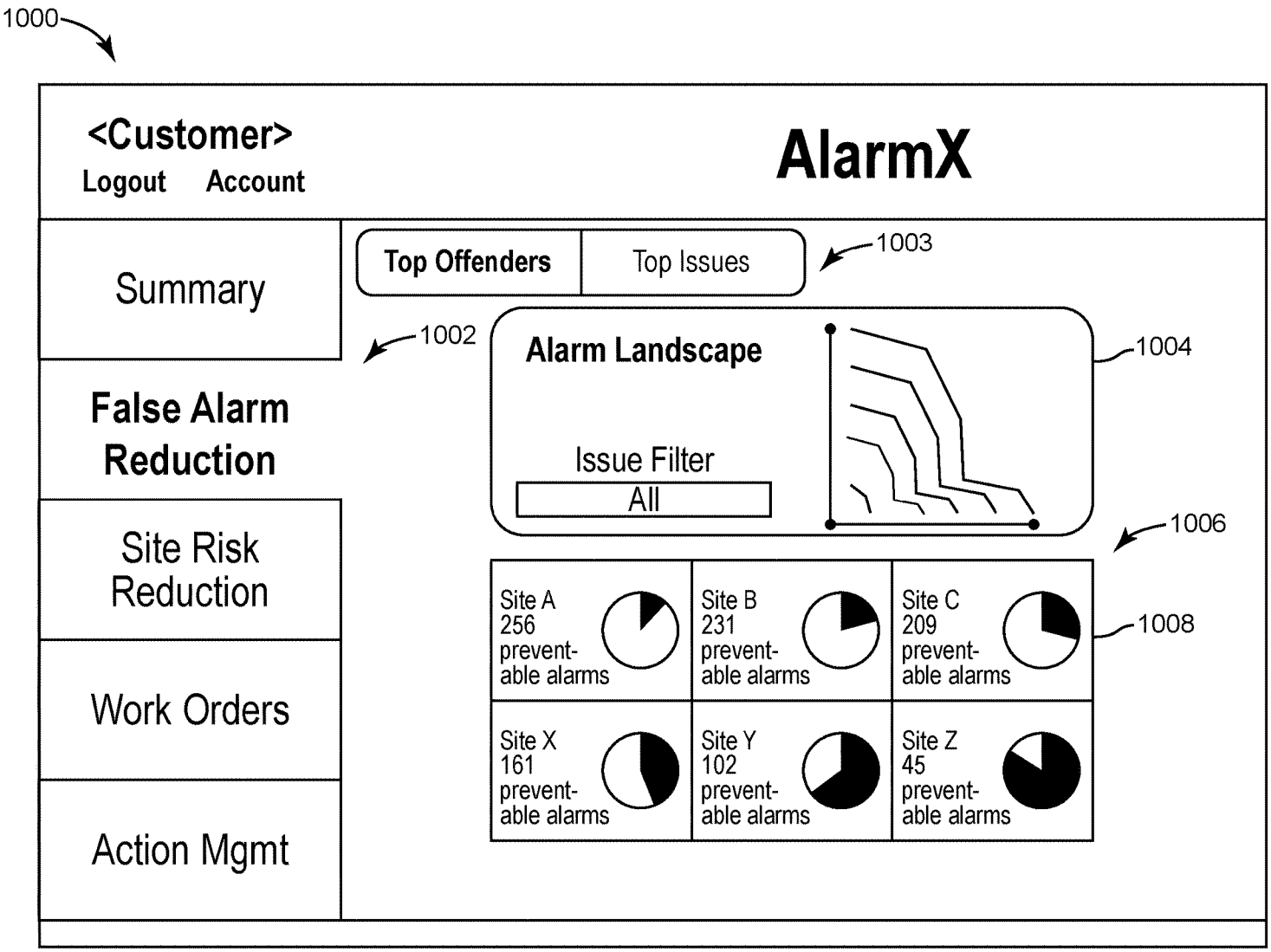
FIG. 10 is a graphical user interface illustrating graphs for multiple building sites indicating how many preventable false alarms were triggered within a time period, according to an exemplary embodiment.

Referring now to FIG. 10, a graphical user interface 1000 illustrating a comparison of how many false alarms were triggered at different building sites within a specific time frame is shown, in some embodiments. Graphical user interface 1000 can be the same as or similar to graphical user interface 900, shown and described with reference to FIG. 9, and/or can be another view of graphical user interface 900. Graphical user interface 1000 is shown to include option panel 1002, offenders or issues choice 1003, alarm landscape 1004, and building site list 1006. Graphical user interface 1000 can be generated by user interface generator 426 of site risk analysis system 310 to display a summary of root cause data generated by another component (not shown) of cloud server 304, shown and described with reference to FIG. 3. A user can press on any of components 1002-1006 and/or portions of components 1002-1006 to request more data from site risk analysis system 310 or other systems of cloud server 304. Option panel 1002 can be the same or similar to option panel 902, shown and described with reference to FIG. 9. Graphical user interface 1000 illustrates a comparison of different building sites and how many preventable false alarms occurred at each site within a user set time period, in some embodiments. Graphical user interface 1000 also illustrates different issues that cause false alarms at alarm landscape 1004, in some embodiments.

Offenders or issues choice 1003 can be an option that users can select to view different interfaces of graphical user interface 1000. As shown, if a user selects top offenders, user interface generator 426 can be configured to display an interface showing a number of preventable false alarms that occur at different building sites, in some embodiments. If a user selects top issues, user interface generator 426 can update the graphical user interface to include a different display showing the issues that caused each false alarm.

Alarm landscape 1004 can be a graph showing the issues that caused each false alarm described in user interface 1000 over time. Alarm landscape can show different data points associated with different building sites along with solid lines representing the average number of instances each issue occurred over time. Each issue that could cause a false alarm can be represented in alarm landscape 1004. Further, users can select a button to identify which issues to show in alarm landscape 1004.

Figure 11:
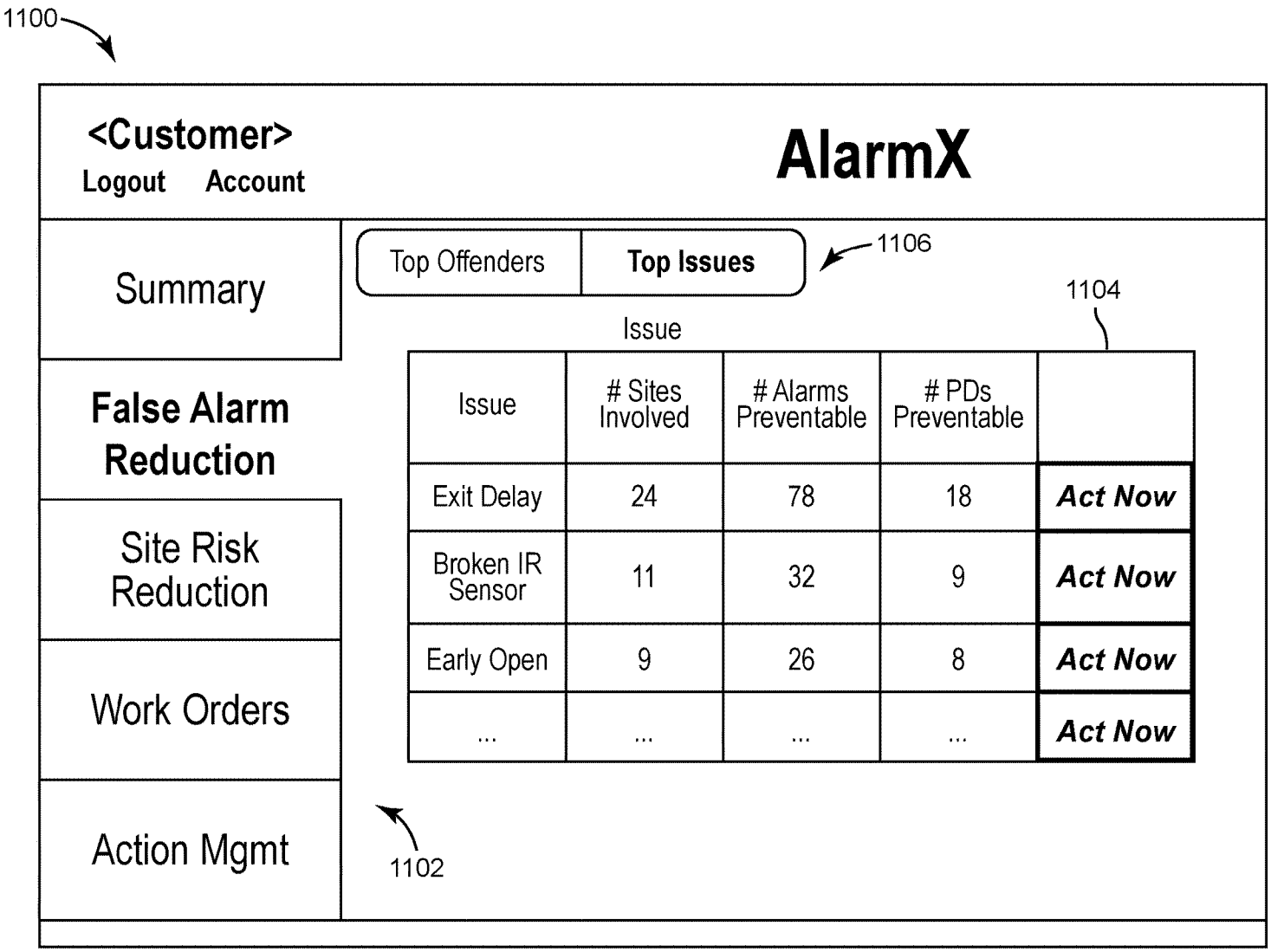
FIG. 11 is a graphical user interface illustrating a table with values representing issues that occurred at multiple building sites, how many building sites experience each issue, how many preventable false alarms were caused by each issue, how many preventable police dispatches were caused by each issue, and an option to act to fix each issue, according to an exemplary embodiment.

Referring now to FIG. 11, a graphical user interface 1100 illustrating a comparison of different issues that caused false alarms and how many building sites the false alarms occurred at is shown, in some embodiments. Graphical user interface 1100 can be the same as or similar to graphical user interface 900, shown and described with reference to FIG. 9, and/or can be another view of graphical user interface 900. Graphical user interface 1100 includes option panel 1102, offenders or issues choice 1103, and issue table 1103, in some embodiments. Option panel 1102 can be the same as or similar to option panel 902, shown and described with reference to FIG. 9, in some embodiments. Offenders or issues choice 1103 can be the same as or similar to offenders or issues choice 1003, shown and described with reference to FIG. 10, in some embodiments. Issue table 1103 includes data associated with different issues that occur at different building sites. Issue table 1103 can include the types of issues that occurred, how many building sites the issues occurred at, how many false alarms each issue caused, and how many preventable police dispatches each issue caused. Issue table 1103 is shown to include act now options 1104 for each issue that a user can select. Upon selecting an act now option, a user can receive instructions on how to solve issues associated with the act now option the user selected, in some embodiments.

Figure 12:
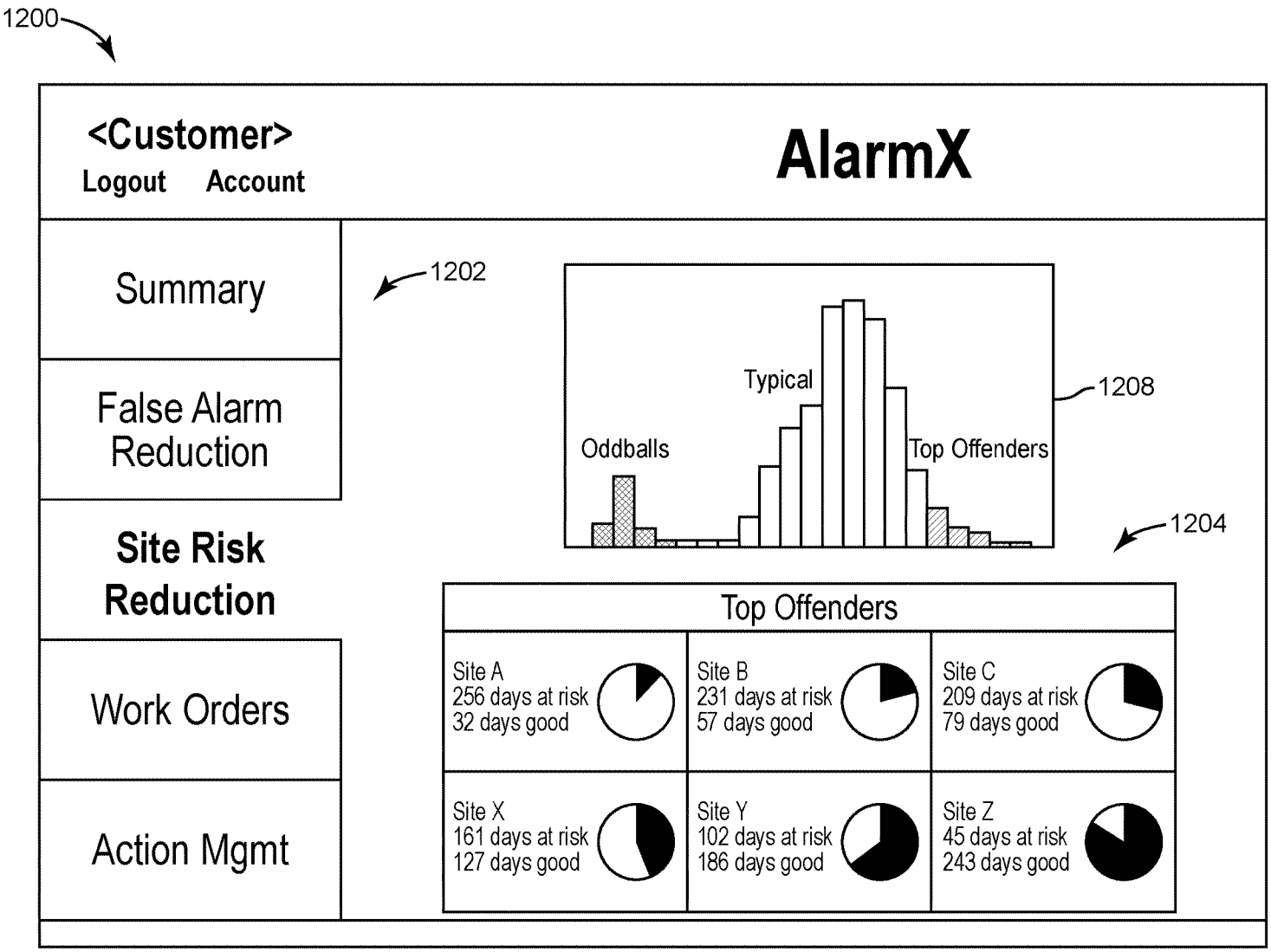
FIG. 12 is a graphical user interface illustrating graphs for multiple building sites indicating how many days each building site was at risk within a time period, according to an exemplary embodiment.

Referring now to FIG. 12, a graphical user interface 1200 illustrating a comparison between different building sites of how many false alarms were triggered at each building within a specific time period is shown, according to some embodiments. Graphical user interface 1200 can be the same as or similar to graphical user interface 900, shown and described with reference to FIG. 9, and/or can be another view of graphical user interface 900. Graphical user interface 1000 is shown to include option panel 1202, daily time at risk histogram 1208, and building site list 1204. Graphical user interface 1000 can be generated by user interface generator 426 of site risk analysis system 310 to display a summary of site risk data collected and analyzed by site risk analysis system 310, in some embodiments. A user can press on any of components 1202-1208 and/or portions of components 1202-1008 to request more data from site risk analysis system 310 or other systems of cloud server 304. Option panel 1202 can be the same or similar to option panel 902, shown and described with reference to FIG. 9. Histogram 1208 can be the same or similar to histogram 600 as shown and described with reference to FIG. 6. Graphical user interface 1200 illustrates a comparison of different building sites and how many days each building site was at risk within a 288-day time period, in some embodiments.

Building site list 1204 is a list including the building sites that were at risk the most days within a 288-day time period, in some embodiments. Each building site of building site list 1204 is described with a number of days each building site was at risk, as determined by site risk analysis system 310 and the number of days each building site not at risk, or was "good." In some embodiments, data collected and generated by site risk analysis system 310 is retrieved from more than six sites, but only the six sites that are at risk the most often are displayed. Any number of building sites can be displayed at building site list 1204.

Figure 13:
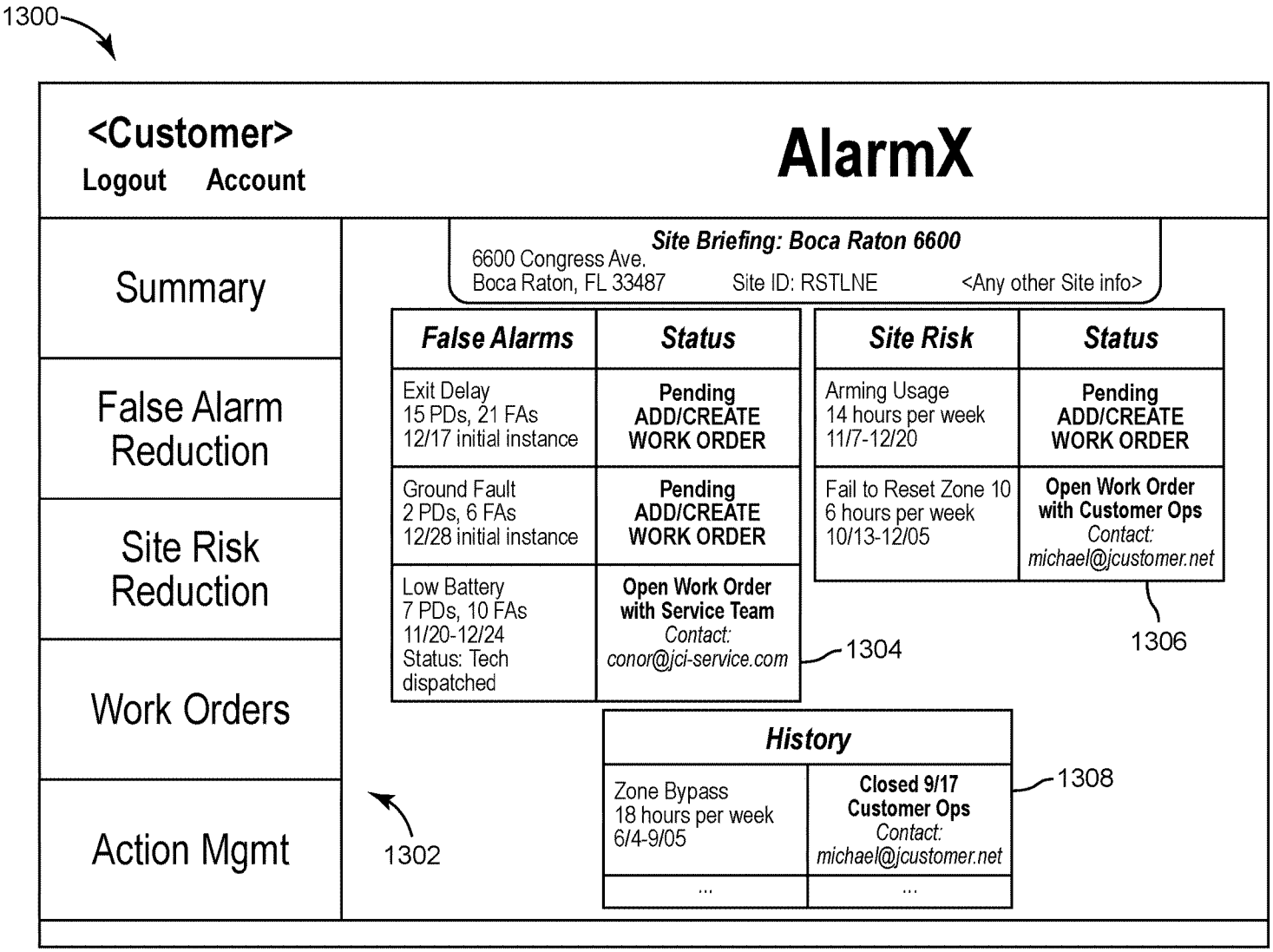
FIG. 13 is a graphical user interface illustrating a summary of false alarms and time at risk for a particular building site, according to an exemplary embodiment.

Referring now to FIG. 13, a graphical user interface 1300 illustrating a summary of false alarms that were triggered at a specific building site, a time at risk of the building site, and a history of the time at risk of the building site is shown, in some embodiments. Graphical user interface 1300 is shown to include option panel 1302, a false alarm summary 1304, a site risk summary 1306, and a site risk history 1308. Option panel 1302 can be the same or similar to option panel 902, shown and described with reference to FIG. 9. False alarm summary 1304 can be a summary of different false alarm issues that occurred at the building site within different time periods. False alarm summary 1304 is shown to include a status for each issue along with data indicating how many times each issue occurred. Site risk summary 1306 can be a summary of different issues that caused the building site to be at risk and a time period that each issue caused the site to be at risk. Site risk summary 1306 can include an average time a day the issue caused the site to be at risk along with a current status of work to fix each issue. Site risk history 1308 shows previous issues that cause the building site to be at risk but that have since been taken care of and consequently closed.

Figure 14:
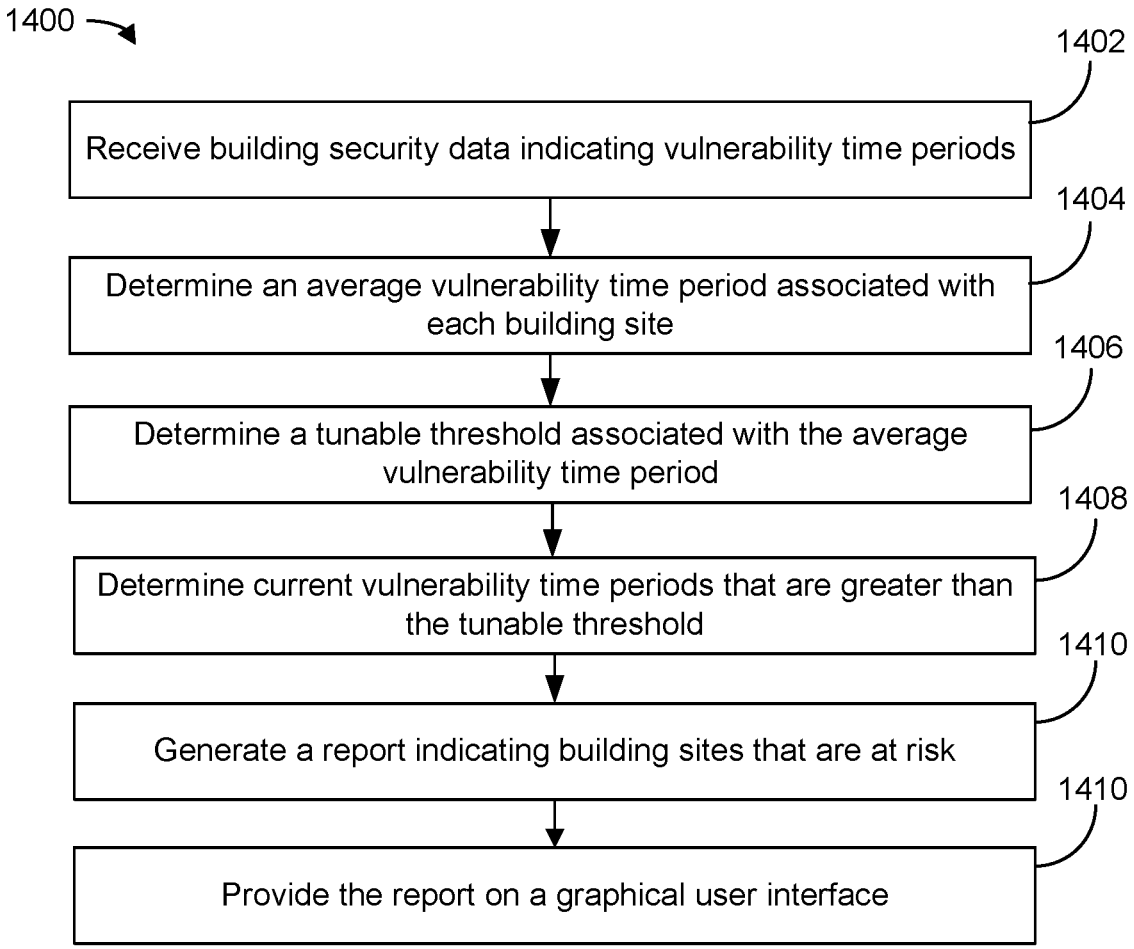
FIG. 14 is a flow diagram of a process for determining building sites that are at risk within a given time period based on a comparison with other building sites, according to an exemplary embodiment.

Referring now to FIG. 14, a flow diagram of a process 1400 for determining which building sites are at risk the most often and providing a report to an administrator displaying results of process 1400 is shown, according to some embodiments. Process 1400 is shown to include receive building security data indicating vulnerability time periods (step 1402), determine an average vulnerability time period for each building site (step 1404), determine current vulnerability time periods for each building site (step 1406), determine current vulnerability time periods that are greater than the average tunable threshold (step 1408), generate a report indicating building sites that are at risk (step 1410), and provide the report on a graphical user interface (step 1410). Process 1400 can include any number of steps and the steps can be performed in any order. In some embodiments, site risk analysis system 310 is configured to perform one, some, or all of the steps 1402-1410.

At step 1402, site risk analysis system 310 can receive building security data that indicates time periods that building sites are at risk, or vulnerability time periods. Building sites are at risk when an aspect of the security system of the building site is not operating correctly. For example, an operator may bypass a zone security system for a room within house for eight hours. Site risk analysis system 310 can receive data indicating that the house was at risk for eight hours. Site risk analysis system 310 can also receive data indicating time periods that security systems of building sites are not at risk, or when the security systems are operating correctly. Site risk analysis system 310 can receive data by polling security systems of different building sites or automatically as the security systems can be configured to send the data to site risk analysis system 310. Site risk analysis system 310 can poll the security systems upon request or based on predetermined time intervals set by a user. Further, building security systems can automatically send security data to site risk analysis system 310 at each instance they experience a vulnerability time period. In some embodiments, site risk analysis system 310 retrieves data from building sites or historical security database 312 once a user requests for a site risk analysis over a specific time period. Site risk analysis system 310 can be configured to retrieve the building security data associated with the specific time period.

At step 1404, site risk analysis system 310 can determine an average vulnerability time period associated with each building site. In some embodiments, the average vulnerability time period is the average time at risk across building sites. Site risk analysis system 310 can determine the average vulnerability time period by determining time periods that each building site is in an at risk state, or vulnerable. Site risk analysis system 310 can determine vulnerability time periods by determining time periods associated with risk types of a building site (i.e. time periods associated with specific risks such as, but not limited to, one of one or more security subsystems not being armed, one or more pieces of equipment not being reset after an alarm, one or more zones being bypassed, one or more communication failure events, one or more supervisory system failure events, etc.). Site risk analysis system 310 can determine the average time each building is at risk based on each risk type, determine an average time period for each building site, and determine an average vulnerability time period across each building site in communication with site risk analysis system 310. In some embodiments, site risk analysis system 310 determines the average time at risk on a per day basis within a time period specified by a user. In some embodiments, site risk analysis system 310 determines the average time at risk based on the total time at risk within the time period specified by a user.

At step 1406, site risk analysis system 310 can be configured to determine a tunable threshold associated with an average vulnerability time period, or an average time at risk. Site risk analysis system 310 can be configured to determine the tunable threshold by determining a standard deviation of the determined average and basing the tunable threshold on a multiple of the standard deviation above the average time at risk. In some embodiments, an administrator determines the multiple of the standard deviation to be associated with the tunable threshold. In some embodiments, site risk analysis system 310 can be configured to determine the tunable threshold to be associated with another value above the average vulnerability time period or time at risk.

At step 1408, site risk analysis system 310 can determine current vulnerability time periods that are greater than the tunable threshold. Current vulnerability time periods can be the time at risk of each building site within the time period specified by the user that is determined by aggregating the times at risk of different risk types as described above. Current vulnerability time periods can be determined per day (or any other time period) of the time period or based on the entire time period. Site risk analysis system 310 can compare the current vulnerability time periods of each day with the tunable threshold to identify days that particular building sites were vulnerable above the tunable threshold. In some embodiments, if the tunable threshold is based on the vulnerability time period of an entire user selected time period, site risk analysis system 310 can identify building sites that were in an at risk state for a time above the tunable threshold associated with the entire user selected time period.

At step 1410, site risk analysis system 310 can be configured to generate a report indicating building sites that are at risk. The report can include any amount of data that was used to determine which building sites were the most at risk within a user selected time period. Site risk analysis system 310 can provide analytics and recommendations based on the data so an administrator can identify causes that particular building sites were at risk and ways to fix and problems. At step 1412, site risk analysis system 310 can provide reports on an interactive graphical user interface that allows users and administrators to ask for more data (e.g., different time periods that building sites could be at risk or more specific data to the current data that was gathered).

Figure 15:
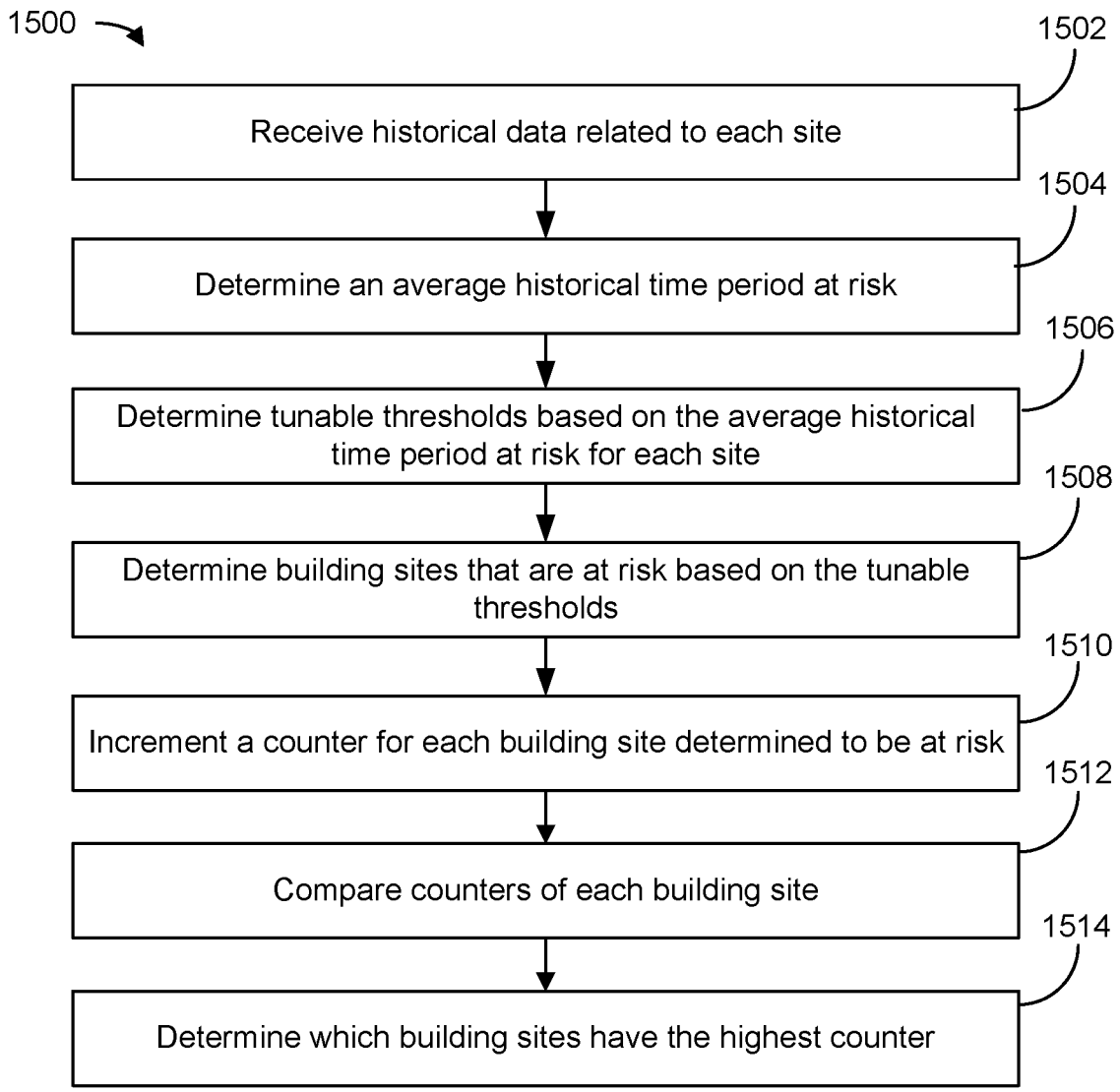
FIG. 15 is a flow diagram of a process for determining tunable thresholds particular to multiple building sites and incrementing a counter when building sites are determined to be at risk, according to an exemplary embodiment.

Referring now to FIG. 15, a flow diagram of a process 1500 for determining a tunable threshold for a building site and determining which building sites are at risk the most often based on building sites associated with the highest counter is shown, in some embodiments. Process 1500 is shown to include receive historical data related to each site (step 1502), determine an average historical time period at risk (step 1504), determine tunable thresholds based on the average historical time period at risk for each site (step 1506), determine building sites that are at risk based on the tunable thresholds (step 1508), increment a counter for each building site determined to be at risk (step 1510), compare counters of each building site (step 1512), and determine which building sites have the highest counter (step 1514), in some embodiments. Process 1500 can include any number of steps and the steps can be performed in any order. In some embodiments, site risk analysis system 310 is configured to perform one, some, or all of the steps 1502-1514.

At step 1502, site risk analysis system 310 can be configured to receive historical security data associated with each building site in communication with site risk analysis system 310. Site risk analysis system 310 can receive the historical security data upon request or automatically similar to or the same as step 1402 as described with reference to FIG. 14. Site risk analysis system 310 can retrieve the historical data related to each site when a user requests for a site risk analysis within a specific time period. However, because site risk analysis system 310 is using the data to determine a tunable threshold specific to each building site, site risk analysis system 310 can retrieve building security data from a time period larger than the time period specified by the user. The time period can be of any duration and can be predetermined by an administrator. This is advantageous because a site risk analysis system 310 can determine an accurate representation of standard operation of each building site even if the time period specified by a user requesting a site risk analysis is small.

At step 1504, site risk analysis system 310 can be configured to determine an average historical time period at risk for each building site. Site risk analysis system 310 can be configured to determine the average on a per-day basis or based on a total time period of the historical time period. Site risk analysis system 310 can determine the average using the methods disclosed herein.

At step 1506, site risk analysis system 310 can be configured to determine tunable thresholds based on the average historical time period at risk for each site. Site risk analysis system 310 can determine the tunable threshold for each site by comparing the average historical time period at risk for all sites to an average time period at risk for each site within a user selected time period. Site risk analysis system 310 can also determine tunable thresholds associated with the average current time period for particular building sites. Site risk analysis system 310 can determine a difference between the average historical time period and the average current time period and adjust the tunable threshold associated with each building site based on the difference between the average historical time period and the average current time period of each building site. For example, if site risk analysis system 310 determines a retail store is historically at risk for an average of 13 hours a day while the rest of the sites are at risk for an average of 11 hours a day, site risk analysis system 310 can adjust a tunable threshold associated with each building site by two hours for the particular retail store. Site risk analysis system 310 can adjust the tunable threshold for the retail store by any amount including a portion or a multiple of the difference between the historical average of a particular building site and the average across all building sites. In some embodiments, an administrator can select a tunable threshold for each particular building site.

At step 1508, in some embodiments, site risk analysis system 310 can be configured to determine building sites that are at risk based on identifying days or time periods where particular building sites are at risk for a time period larger than the tunable threshold specific to the particular building site. Site risk analysis system 310 can compare the vulnerability time periods associated with each building site for each day or user selected time period to the tunable threshold specific to each building site. If the vulnerability time period of a building site exceeds a tunable threshold specific to the site, site risk analysis system 310 can be configured to determine the building site to be at risk for that specific day or time period.

At step 1508, site risk analysis system 310 can increment a counter for each day that a building site was determined to be at risk. In some embodiments, if site risk analysis system 310 is configured to determine at risk building sites based on total time at risk of a building site, site risk analysis system 310 can increment a counter for the total time at risk of the building site (e.g., 20 hours within a week time period). At step 1510, site risk analysis system 310 can compare the counters of each building site. At step 1512, site risk analysis system 310 can determine which building sites have the highest counter. In some embodiments, site risk analysis system 310 provides the building sites associated with the highest counter to a user at a graphical user interface in descending order to show the user which building sites need the most attention.

Figure 16:
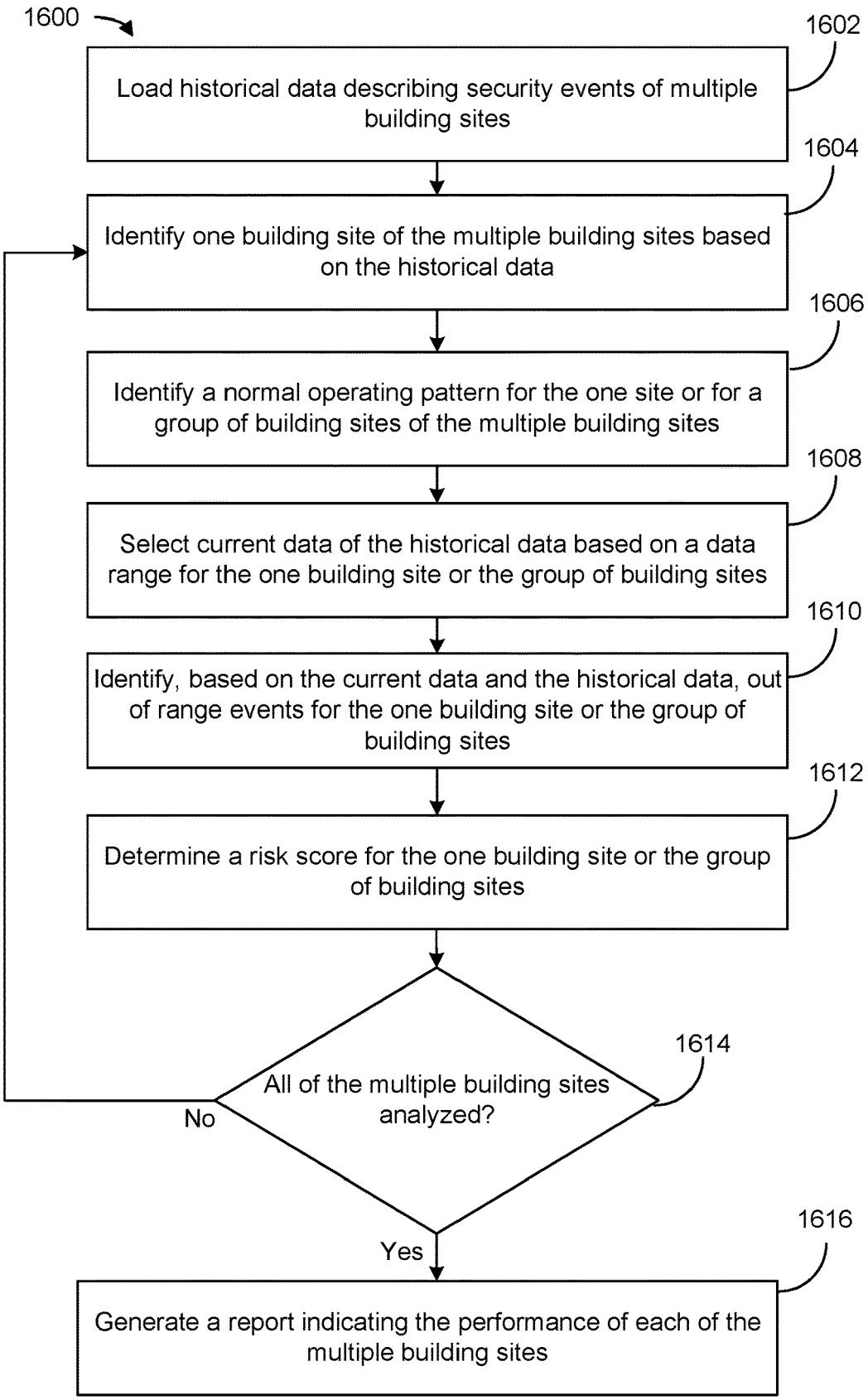
FIG. 16 is a flow diagram of a process for determining a risk score for one or more building sites based on building data related to a time at risk for each building site, according to an exemplary embodiment.

Referring now to FIG. 16, a flow diagram of a process 1600 describing another implementation of a system and method of determining building sites that are at risk based on determining a risk score for one or more building sites and generating a report displaying the risk score is shown, according to some embodiments. Process 1600 is shown to include load historical data describing security events of multiple building sites (step 1602), identify one building site of the multiple building sites based on the historical data (step 1604), identify a normal operating pattern for the one site or for a group of building sites of the multiple building sites (step 1606), select current data of the historical data based on a data range for the one building site or the group of building sites (step 1608), identify, based on the current data and the historical data, out of range events for the one building site or the group of building sites (step 1610), determine a risk score for the one building site or the group of building sites (step 1612), all of the multiple building sites analyzed? (step 1614), and generate a report indicating the performance of each of the multiple building sites (step 1616), in some embodiments. Process 1600 can include any number of steps and the steps can be performed in any order. In some embodiments, site risk analysis system 310 is configured to perform one, some, or all of the steps 1602-1616.

At step 1602, site risk analysis system 310 can be configured to load historical building security data associated with multiple building sites that site risk analysis system 310 is monitoring. Step 1602 can be the same as or similar to steps 1402 and/or 1502, shown and described with reference to FIGS. 14 and 15. Site risk analysis system 310 can collect all historical building security data associated with each building site. At step 1604, site risk analysis system 310 can be configured to identify one or more building sites of the multiple building sites. Site risk analysis system 310 can identify the building sites based on tags on the historical building security data indicating which building site the historical building security data is associated with.

At step 1606, site risk analysis system 310 can be configured to identify normal operating patterns of individual building sites or groups of building sites. For example, historical security data from a site may indicate when the security system of the building site is usually disarmed (i.e. a time period the building site is at risk). Various data processing methods (e.g. distribution analysis) can be used to identify a normal risk state of each building site. At step 1608, data is selected from the historical building security data based on user defined requirements, such as, but not limited to, a date range, a type of building site, etc.

At step 1610, site risk analysis system 310 can be configured to identify out of range events for the one building site or the group of building sites. An out of range event can be determined by comparing selected data against normal data of the one building site or the group of building sites such as, for example, a building site that is disarmed for a duration that exceeds its normal disarmed duration at a comparable time during the course of a day. Another example can be a site security system that is disarmed at a different time within a time period compared to its normal profile. At step 1612, site risk analysis system 310 can determine a risk score for the one building site or the group of building sites. The risk score can be represented by a counter indicating the number of out of range events a building site or building sites experience within a user selected time period.

At step 1614, site risk analysis system 310 can be configured to determine if each building site in communication with site risk analysis system 310 has been included in the calculations for determining site risk scores of all building types. If all of the building sites have not been analyzed, process 1600 returns to step 1604 and repeats steps 1604-1614 until all of the building sites have been analyzed. If all of the building sites have been analyzed, however, at step 1616, site risk analysis system 310 can generate a report indicating the performance of each of the multiple building sites. In some embodiments, the report can indicate a risk score similar to the counter implemented in processes 1400 and 1500, shown and described with reference to FIGS. 14 and 15.

Advantageously, by using adaptive tunable thresholds and comparing the security of building sites to each other, site risk analysis system 310 can automatically determine building sites that are the most at risk of security breaches and fire hazards. Systems not implementing the systems and methods described herein could only identify individual events that different building sites were at risk without a method of determining which building site needs the most attention. Consequently, because site risk analysis system 310 can identify how long different building sites were at risk using time at risk data specific to each building site, risk analysis system 310 can quickly determine which building sites need the attention of an administrator and provide a report to the administrator. Further, site risk analysis system 310 can automatically determine if a security system can change configurations (e.g., adjust parameters) itself to become a more secure system. In such instances, site risk analysis system 310 can send instructions to the security system indicating a change in parameters that would cause the security system to be more secure.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A security system for identifying at risk building sites, the security system in communication with a plurality of security subsystems of a plurality of building sites, the security system comprising a processing circuit configured to:

receive building security data from the plurality of building sites, the building security data indicating one or more vulnerability time periods for each of the plurality of building sites;

determine an average vulnerability time period associated with each of the plurality building sites based on the one or more vulnerability time periods;

determine a tunable threshold associated with the average vulnerability time period;

determine whether each of the plurality of building sites are at risk by determining whether a current vulnerability time period for each building site is greater than the tunable threshold associated with the average vulnerability time period; and generate a report indicating one or more of the plurality of building sites that are at risk.

2. The security system of claim 1, wherein the processing circuit is configured to provide the report on a graphical user interface displaying reports associated with each of the plurality of building sites.

3. The security system of claim 1, wherein the building security data comprises risk data of the plurality of building sites, wherein the risk data indicates a plurality of different risk types comprising at least one of one or more security subsystems not being armed, one or more pieces of equipment not being reset after an alarm, one or more zones being bypassed, one or more communication failure events, or one or more supervisory system failure events.

4. The security system of claim 3, wherein the processing circuit is configured to determine risk vulnerability time periods based on the risk data for each of the plurality of risk types for each of the plurality of building sites.

5. The security system of claim 4, wherein the processing circuit is configured to determine the current vulnerability time period for each building site by aggregating the risk vulnerability time periods for each building site.

6. The security system of claim 1, wherein the tunable threshold is particular to each building site;

wherein the processing circuit is configured to determine whether each of the plurality of building sites are in a risk state by determining whether the current vulnerability time period of the building site exceeds the tunable threshold particular to each building site.

7. The security system of claim 6, wherein the processing circuit is configured to determine the tunable threshold particular to each building site based on historical vulnerable time periods associated with each building site.

8. The security system of claim 6, wherein each of the plurality of building sites is associated with a counter of a plurality of counters;

wherein the processing circuit is configured to increment the counter of each of the plurality of building sites in response to a determination that a state of the building site becomes the risk state.

9. The security system of claim 8, wherein the processing circuit is configured to determine a group of building sites of the plurality of building sites with highest count values by analyzing a count value of each of the plurality of counters.

10. A method for identifying at risk building sites, the method conducted by a processing circuit and comprising:

receiving, by the processing circuit, building security data from a plurality of building sites, the building security data indicating one or more historical vulnerability time periods for each of the plurality of building sites;

determining, by the processing circuit, an average vulnerability time period associated with each of the plurality building sites based on the one or more vulnerability time periods;

determining, by the processing circuit, a tunable threshold associated with the average vulnerability time period;

determining, by the processing circuit, whether each of the plurality of building sites are at risk by determining whether a current vulnerability time period for each building site is greater than the tunable threshold associated with the average vulnerability time period; and generating, by the processing circuit, a report indicating one or more of the plurality of building sites that are at risk.

11. The method of claim 10, comprising:

providing, by the processing circuit, the report on a graphical user interface displaying reports associated with each of the plurality of building sites.

12. The method of claim 10, comprising:

determining, by the processing circuit, acceptable time periods for each of the plurality of building sites to be in an at risk state, and remove building security data associated with the acceptable time periods from the building security data.

13. The method of claim 10, wherein the building security data comprises risk data of the plurality of building sites, wherein the risk data indicates a plurality of different risk types comprising at least one of one or more security subsystems not being armed, one or more pieces of equipment not being reset after an alarm, one or more zones being bypassed, one or more communication failure events, or one or more supervisory system failure events.

14. The method of claim 13, comprising:

determining, by the processing circuit, risk vulnerability time periods based on the risk data for each of the plurality of risk types for each of the plurality of building sites.

15. The method of claim 14, comprising:

determining the current vulnerability time period for each building site by aggregating the risk vulnerability time periods for each building site.

16. The method of claim 10, wherein the tunable threshold is particular to each building site; the method comprising:

determining whether each of the plurality of building sites are in a risk state by determining whether the current vulnerability time period of the building site exceeds the tunable threshold particular to each building site.

17. The method of claim 16, comprising:

determining the tunable threshold particular to each building site based on historical vulnerable time periods associated with each building site.

18. A non-transitory computer-readable storage medium having instructions stored thereon that, upon execution by a processor, cause the processor to perform operations to identify at risk building sites, the operations comprising:

receiving building security data from a plurality of building sites, the building security data indicating one or more historical vulnerability time periods for each of the plurality of building sites;

determining an average vulnerability time period associated with each of the plurality building sites based on the one or more vulnerability time periods;

determining a tunable threshold associated with the average vulnerability time period;

determining whether each of the plurality of building sites are at risk by determining whether a current vulnerability time period for each building site is greater than the tunable threshold associated with the average vulnerability time period; and generating a report indicating one or more of the plurality of building sites that are at risk.

19. The non-transitory computer-readable storage medium of claim 18, wherein the operations comprise:

providing the report on a graphical user interface displaying reports associated with each of the plurality of building sites.

20. The non-transitory computer-readable storage medium of claim 18, wherein the building security data comprises risk data of the plurality of building sites, wherein the risk data indicates a plurality of different risk types comprising at least one of one or more security subsystems not being armed, one or more pieces of equipment not being reset after an alarm, one or more zones being bypassed, one or more communication failure events, or one or more supervisory system failure events.

* * * * *